US008632141B2

(12) United States Patent
Park et al.

(10) Patent No.: US 8,632,141 B2
(45) Date of Patent: Jan. 21, 2014

(54) SLIDING APPARATUS WITH SELF-CLOSING MEANS

(75) Inventors: Yoon Sig Park, Seoul (KR); Hyun Ho Cha, Koyang-shi (KR)

(73) Assignee: Segos Co., Ltd., Incheon (KR)

( * ) Notice: Subject to any disclaimer, the term of this patent is extended or adjusted under 35 U.S.C. 154(b) by 479 days.

(21) Appl. No.: 12/853,551

(22) Filed: Aug. 10, 2010

(65) Prior Publication Data

US 2011/0037362 A1 Feb. 17, 2011

(30) Foreign Application Priority Data

| | | |
|---|---|---|
| Aug. 12, 2009 | (KR) | 10-2009-0074465 |
| Aug. 12, 2009 | (KR) | 10-2009-0074467 |
| Aug. 12, 2009 | (KR) | 10-2009-0074468 |
| Aug. 12, 2009 | (KR) | 10-2009-0074469 |
| Nov. 12, 2009 | (KR) | 10-2009-0109265 |
| Nov. 12, 2009 | (KR) | 10-2009-0109267 |
| Dec. 22, 2009 | (KR) | 10-2009-0129172 |
| Dec. 22, 2009 | (KR) | 10-2009-0129173 |

(51) Int. Cl.
*A47B 88/00* (2006.01)

(52) U.S. Cl.
USPC ..... 312/333; 312/331

(58) Field of Classification Search
USPC ..... 312/319.1, 333, 402, 404, 331, 334.6, 312/334.1, 334.7, 334.8; 384/22, 21; 74/422; 62/382, 440; 188/82.1
See application file for complete search history.

(56) References Cited

U.S. PATENT DOCUMENTS

| | | | | |
|---|---|---|---|---|
| D635,789 | S * | 4/2011 | Rechberg et al. | D6/377 |
| 8,152,250 | B2 * | 4/2012 | Aguilar et al. | 312/331 |
| 8,282,177 | B1 * | 10/2012 | Rotter | 312/402 |
| 2004/0104649 | A1 * | 6/2004 | Muller et al. | 312/333 |
| 2005/0092217 | A1 * | 5/2005 | Yang | 108/189 |
| 2005/0160854 | A1 * | 7/2005 | Rotter | 74/422 |
| 2006/0238089 | A1 * | 10/2006 | Prentner et al. | 312/333 |
| 2007/0144408 | A1 * | 6/2007 | Rotter | 108/16 |
| 2008/0211365 | A1 * | 9/2008 | Moll et al. | 312/319.1 |
| 2009/0121596 | A1 * | 5/2009 | Ferrari | 312/334.8 |
| 2009/0195131 | A1 * | 8/2009 | Chi et al. | 312/319.1 |
| 2009/0261698 | A1 * | 10/2009 | Cabal Velarde et al. | 312/334.8 |

(Continued)

FOREIGN PATENT DOCUMENTS

| | | | |
|---|---|---|---|
| JP | 2005230468 | * | 9/2005 |
| JP | 20102844378 | * | 12/2010 |
| WO | 2010148907 | * | 12/2010 |

*Primary Examiner* — Janet M Wilkens
(74) *Attorney, Agent, or Firm* — The PL Law Group, PLLC

(57) ABSTRACT

A sliding apparatus with a self-closing unit. The apparatus includes a rail bracket provided on each of opposite sides of a main body to face a movable rail, having a cover space spaced apart from the main body, and supporting a fixed rail in a direction towards the movable rail. A self-closing unit is provided at a predetermined position on the fixed rail and secured to the rail bracket. A cover protrudes from each of the opposite sides of the storage part to surround the sliding apparatus and the self-closing unit, and moves along with the storage part to be inserted into the cover space when the storage part is closed. A drive part is provided at a predetermined position on the cover, protrudes towards the self-closing unit, and moves along with the storage part to be latched by the self-closing unit.

6 Claims, 27 Drawing Sheets

(56) References Cited

U.S. PATENT DOCUMENTS

2009/0322196 A1* 12/2009 Park ..... 312/404
2010/0086244 A1* 4/2010 Bonat ..... 384/19
2010/0123378 A1* 5/2010 Chen et al. ..... 312/333
2010/0283365 A1* 11/2010 Chen ..... 312/334.4
2011/0115353 A1* 5/2011 Domenig et al. ..... 312/333
2012/0038255 A1* 2/2012 Netzer et al. ..... 312/319.1

* cited by examiner

SLIDING APPARATUS WITH SELF-CLOSING MEANS

CROSS REFERENCE

This application claims foreign priority under Paris Convention and 35 U.S.C. §119 to Korean Patent Application No. 10-2009-0074468, filed Aug. 12, 2009, and Korean Patent Application No. 10-2009-0129173 filed 22 Dec. 2009, and Korean Patent Application No. 10-2009-0074467 filed 12 Aug. 2009, and Korean Patent Application No. 10-2009-0129172 filed 22 Dec. 2009, and Korean Patent Application No. 10-2009-0074469 filed 12 Aug. 2009, and Korean Patent Application No. 10-2009-0109267 filed 12 Nov. 2009, and Korean Patent Application No. 10-2009-0074465 filed 12 Aug. 2009, and Korean Patent Application No. 10-2009-0109265 filed 12 Nov. 2009 with the Korean Intellectual Property Office.

BACKGROUND OF THE INVENTION

1. Technical Field

The present invention relates to a sliding apparatus with a self-closing means.

2. Description of the Related Art

Generally, sliding apparatuses are built so that storage parts that store various kinds of articles therein and are part of furniture, refrigerators, or various kinds of filling cabinets slide between the opened and closed positions. The main body of the piece of furniture, refrigerator, or of the filling cabinets which come in a variety of different kinds contains a space for installing the storage part, and the sliding apparatus is provided on the inner wall of the space and opposite sides of the storage part to perform the sliding operation using a rolling type of contact. The storage part equipped with the sliding apparatus slides in the space of the main body because of the sliding apparatus and in doing so opens or closes, thus allowing articles to be put into or taken out of the storage part. That is, the sliding apparatus connects the storage part to the main body, and the storage part can slide smoothly because the sliding apparatus is rolled when the storage part is opened or closed.

As described above, the conventional sliding apparatus for sliding the storage part is constructed so that fixed rails and movable rails are mounted on the main body and the storage part, respectively, using sliding means, such as a ball or a roller, which perform the sliding operation using a rolling type of contact. The fixed and movable rails are slidably coupled to each other by the sliding means, such as a ball or a roller, which perform the sliding operation using the rolling type of contact. Thus, when the storage part is pushed in or pulled out, the movable rails slidably move along the fixed rails via the sliding means.

Further, the sliding apparatus is provided between the moving storage part and the main body, and the sliding apparatus is problematic in that the sliding rails are exposed at the inner portion of the main body and the outer portion of the storage part which is pulled out. Especially in the case of a refrigerator, the main body is full of cool air which may cause drops of water to condense, and the drops of water formed by the condensation may freeze in the cool air to form frost. If the frost is formed on the sliding surface of the sliding apparatus which is exposed, the operability of the sliding apparatus is deteriorated.

Further, the storage part used in a device for storing foodstuffs, such as a refrigerator, and the sliding apparatus are painted white. However, as the sliding apparatus repeatedly slides, the white paint peels off, so that the sliding apparatus must be replaced with a new one. As such, the life-span of the sliding apparatus is reduced.

Further, the sliding apparatus moves while rolling using the sliding means, thus allowing the storage part to be easily moved just by a small amount of force. However, since the storage part coupled via a sliding member can slide even under a small amount of force, the closed storage part may slide because of gravity and be moved out. For example, if the conventional sliding apparatus is provided on the main body of a refrigerator or the like, the storage part slides because of gravity and is moved out, so that cool air may escape out.

In order to solve the problem, in recent years, a sliding apparatus is installed to incline downwards from the open to the closed side. Thus, even if the storage part slides because of gravity, the gravity acts in the closing direction, thus preventing the storage part from being undesirably opened.

However, the conventional sliding apparatus is problematic in that, even when the storage part stops opening at a certain point or has been completely opened, the storage part may slide because of gravity and move in the closing direction, so that it is difficult for a user to maintain the storage part in a partially opened state.

The aforesaid sliding apparatus may be equipped with a self-closing means which is provided on the fixed rail mounted on the main body to move the movable rail mounted on the storage part using elasticity. When the storage part reaches a position where the self-closing operation is performed during the closing operation of the storage part, the self-closing means latches the storage part, so that the storage part is automatically closed by the elastic force. After the storage part has been closed, the storage part is kept closed by the elastic force. When the storage part is supposed to be opened, the storage part is released from the self-closing means, so that the storage part can be operated and be opened.

The self-closing means is problematic in that the elastic member having an elastic force which acts as a self-closing force during the self-closing operation comprises a single member, so that it is difficult to control the elastic force. That is, the self-closing operation of the storage part is implemented by the elastic force which is generated when the elastic member is restored from a stretched state to the original state thereof. Thus, in order to control the elastic force, the elastic member must be replaced with another one having the desired elastic force. Therefore, if the elastic member having a large elastic force is used to increase the force used to perform the self-closing operation, it is difficult for a user to pull out the elastic member of the large elastic force and move the storage part in the opening direction. Meanwhile, if the elastic member having a small force is used to smoothly pull the storage part out, it is easy to pull out the storage part, but the self-closing function is deteriorated. Thus, the closing operation may be stopped even though the storage part has not completely closed.

Further, pinion gear units may be rotatably supported on the opposite sides of the storage part equipped with the conventional sliding apparatus, and rack units may be provided on the fixed rails facing the opposite sides equipped with the pinion gear units to engage with the corresponding pinion gear units. Each rack unit is fastened to the corresponding fixed rail using a bolt or a rivet, and engages with the corresponding pinion gear unit within the sliding section of the storage part. When the storage part equipped with the sliding apparatus moves, each pinion gear unit is rotated while engaging with the corresponding rack unit. As the pinion gear units provided on the opposite sides are rotated while engaging with the corresponding rack units having teeth of the same size, both sides of the storage part may be moved at the same speed. Thus, both sides of the storage part are moved at the same speed by the pinion gear units and the rack units which engage with each other, so that the twisting of the storage part due to a difference in moving speed can be prevented.

In the sliding apparatus having the pinion gear units and the rack units, each rack unit is installed at an associated fixed rail to which the corresponding movable rail is slidably coupled. Thus, in order to prevent interference between the rack units and the pinion gear units, the sliding section of the movable rail includes a distance wherein a self-closing operation takes place. Since the operating distance of the self-closing means is included in the sliding section of the movable rail, the sliding section of the movable rail is undesirably limited.

Therefore, the conventional self-closing means must also adjust the sliding distance of the sliding apparatus when the operating distance of the self-closing means is adjusted. That is, if the operating distance of the self-closing means is adjusted to be longer, the sliding distance of the sliding apparatus becomes shorter. The operating distance of the sliding apparatus is determined by the size of the storage part and the space of the main body accommodating the storage part. Thus, the distance required for the self-closing operation of the self-closing means is limited, so that it is difficult to adjust the distance for the self-closing operation.

Further, the conventional self-closing means is problematic in that it must be installed in consideration of the sliding distance of the sliding apparatus and the distance wherein the self-closing operation takes place, so that it is difficult to install the self-closing means.

SUMMARY OF THE INVENTION

Accordingly, the present invention has been made keeping in mind the above problems occurring in the prior art, and an object of the present invention is to provide a sliding apparatus with a self-closing means, which prevents part of the sliding apparatus secured to a storage part from being exposed to the external environment, and in which a plurality of elastic members having different elastic forces and coupled in series is provided to the self-closing means to perform a self-closing operation, thus improving self-closing performance, and in which the size of a gear of a gear unit for allowing the opposite sides of the storage part to maintain the same speed is adjusted to keep the storage part opened, and in which a self-closing function can be provided to the gear unit, thus improving the efficiency with which the storage part is moved.

In order to accomplish the above object, the present invention provides a sliding apparatus with a self-closing means, having a movable rail provided on each of opposite sides of a storage part, and a fixed rail provided on a main body and coupled to the movable rail via a sliding member in such a way as to be in rolling contact with the movable rail, the sliding apparatus including a rail bracket provided on each of opposite sides of the main body in such a way as to face the movable rail, having a cover space spaced apart from the main body, and supporting the fixed rail in a direction towards the movable rail; a self-closing means provided at a predetermined position on the fixed rail, and secured to the rail bracket; a cover protruding from each of the opposite sides of the storage part to surround the sliding apparatus and the self-closing means, and moving along with the storage part to be inserted into the cover space when the storage part is closed; and a drive part provided at a predetermined position on the cover, protruding towards the self-closing means, and moving along with the storage part to be latched by the self-closing means, wherein the cover surrounds the movable rail when the cover moves along with the storage part and the storage part is opened, and the cover is inserted into the cover space when the storage part is closed, thus surrounding and protecting the movable rail, the fixed rail, and the rail bracket, and the self-closing means is provided at the predetermined position on the fixed rail which does not interfere with the movable rail moving along with the storage part, and latches the drive part to adjust an operating position and an operating distance when self-closing.

Further, the self-closing means may include a closing housing provided at a predetermined position on the fixed rail, secured to the rail bracket, and having a closing space which passes through the closing housing in a moving direction of the drive part; a guide means provided in the closing housing in such a way as to be located at a position in the closing space, and including a linear part provided on a central portion of the guide means in such a way as to extend from a closed position to an open position of the storage part, and having a shape of a straight line, and a curved part provided on an end of the linear part located at the open position in such a way as to be bent in a predetermined direction, and having a shape of a curve; a movable latching part provided in the closing housing in such a way as to be located in the closing space, and movably guided along the guide means, a latching depression being formed at a predetermined position in the movable latching part to latch the drive part; and an elastic member elastically coupling the closing housing with the movable latching part, wherein the movable latching part is guided along the guide means while being elastically coupled to the elastic member, and is automatically moved in a closing direction by an elastic force when the storage part is closed, and the movable latching part is guided to the curved part when the movable latching part moves in an opening direction of the storage part, so that a portion of the latching depression located in the opening direction moves downwards and thus the drive part is released from the movable latching part, and the drive part is latched by the latching depression located in the curved part when the storage part is opened and then moves in the closing direction, so that the storage part is automatically closed by elastic force of the elastic member.

An elastic deformation hole may be bored through a portion of the closing housing in such a way as to communicate with the closing space, thus allowing the guide means to be elastically deformed in the closed position.

The sliding apparatus may further include a damper provided in the closing housing, the damper making contact with a portion of the movable latching part located in the closing direction of the storage part, wherein the damper absorbs some the elastic force when the movable latching part is moved by the elastic force of the elastic member, thus achieving a smooth operation.

The sliding apparatus may further include a fastening bent part provided on an end of the rail bracket located in an inner portion of the main body, and protruding towards the cover space and bent so as to be in contact with the main body; a fastening extension part extending from the end of the rail bracket located in the inner portion of the main body, and connected to the fastening bent part in such a way as to be in contact with the main body; and a fastening means for fastening the fastening extension part to the main body, wherein the rail bracket is connected, via the fastening bent part, to the fastening extension part which is bent to the cover space and is in contact with the main body, and the fastening extension part is fastened to the main body via the fastening means, so that the rail bracket is fastened to the main body via the fastening means while forming the cover space.

Further, the self-closing means may include a closing body provided on each of opposite sides of the main body, the closing body being located at a predetermined position of the sliding apparatus and having a body space which passes through the closing body so that the drive part is inserted into the body space; a guide wall protruding in the closing body, and provided in the body space in such a way as to protrude from a first side to a second side of the body space; a latching body provided in the closing body in such a way as to be located in the body space, having a latching depression at a position into which the drive part is to be inserted, and having on a side surface thereof a guide recess which is inserted into the guide wall to be guided therealong; and an elastic means elastically coupling the closing body with the latching body, and having a plurality of elastic members which have different elastic forces and are coupled in series, wherein the plurality of elastic members of the elastic means which are coupled in series have different elastic forces, so that, when the storage part is opened, each of the elastic members having the different elastic forces is stretched and thus a user discerns an open position because of a change in elasticity, and, when the storage part is closed, the storage part is rapidly closed by a sum of the forces of the elastic members which are coupled in series.

The elastic means may further include at least one connector, the connector being placed between the plurality of elastic members and having on opposite ends thereof connecting recesses so that the elastic members having the different elastic forces are inserted into the connecting recesses to be connected in series, and the connector connects the plurality of elastic members having the different elastic forces in series by inserting the elastic members into the connecting recesses provided in opposite ends of the connector.

The guide wall may include a linear guide part having a shape of a straight line and extending from the closed position to the open position of the storage part; and a curved guide part connected to an end of the linear guide part located in the opening direction of the storage part, and bent perpendicularly to the linear guide part, whereby the movable latching part is movably guided from the linear guide part to the curved guide part, so that the drive part is latched to or released from the latching depression.

An inclined surface may be provided to increase a sectional area from an end of the latching body located in the opening direction of the storage part to the latching depression, and a through hole may be formed in a portion of the closing body in such a way as to be located at a position of the linear guide part placed in the closing direction of the storage part, so that the guide wall is elastically deformed in the through hole, whereby, in the event of a malfunction where the drive part is in an open position but the latching body is located in a closed position of the linear guide part, the storage part is forcibly moved to be closed, so that the inclined surface is pressed and the latching body elastically deforms the linear guide part in the through hole, and thus the drive part is latched by the latching depression.

The sliding apparatus may further include a closing damper provided in the closing body in such a way as to be in contact with a portion of the latching body located in the closing direction of the storage part, the closing damper absorbing some of the elastic force when the movable latching part is moved by the elastic force of the plurality of elastic members, thus achieving a smooth operation.

The self-closing means may include a closing body provided on each of opposite sides of the main body, located at a predetermined position of the sliding apparatus, and having a body space which passes through the closing body so that the drive part is inserted into the body space, and an elongate guide hole formed at a predetermined position in the body space; a latching body provided in the closing body, placed in the body space, having a latching depression at a position into which the drive part is to be inserted, and having on a side surface thereof a guide protrusion which is inserted into the guide hole and is movably guided therealong; and an elastic means elastically coupling the closing body with the latching body, and having a plurality of elastic members which have different elastic forces and are coupled in series, wherein the plurality of elastic members of the elastic means which are coupled in series have different elastic forces, so that, when the storage part is opened, each of the elastic members having the different elastic forces is stretched and thus a user discerns an open position because of a change in elasticity, and, when the storage part is closed, the storage part is rapidly closed by a sum of the forces of the elastic members which are coupled in series.

The elastic means may further include at least one connector which is placed between the plurality of elastic members and has on opposite ends thereof connecting recesses such that the elastic members having different elastic forces are connected in series, the connector connects the plurality of elastic members in series, by inserting the elastic members, having the different elastic forces, into the connecting recesses provided on the opposite ends of the coupler.

The guide hole may include a linear guide part having a shape of a straight line and extending from the closed position to the open position of the storage part, and a curved guide part connected to an end of the linear guide part located in the opening direction of the storage part, bent perpendicularly to the linear guide part, and having a shape of a curve, whereby the latching body is movably guided from the linear guide part to the curved guide part, so that the drive part is latched to or released from the latching depression.

An inclined surface may be provided to increase a sectional area from an end of the latching body located in the opening direction of the storage part to the latching depression, and a guide elastic deformation hole may be formed through a portion of the closing body placed in the closing direction of the storage part in such a way as to partially communicate with the linear guide part of the guide hole. Thereby, in the event of a malfunction where the drive part is in an open position but the latching body is located in a closed position of the linear guide part, the storage part is forcibly moved to be closed, so that the inclined surface is pressed and the latching body elastically deforms the linear guide part at a position partially communicating with the guide elastic deformation hole, and thus the drive part is latched by the latching depression.

The sliding apparatus may further include a closing damper provided in the closing body, the closing damper making contact with a portion of the latching body located in the closing direction of the storage part, wherein the closing damper absorbs some of the elastic force when the latching body is moved by the elastic force of the plurality of elastic members, thus achieving a smooth operation.

The sliding apparatus may further include pinion gear units provided on the opposite sides of the storage part, each of the pinion gear units having a cylindrical shape, with teeth formed on an outer circumference of each of the pinion gear units; a coupling bar rotatably supported on a side of the storage part, and coupling the pinion gear units to each other; and rack gear units provided on opposite sides of the rail brackets, each of the rack gear units having on a portion thereof teeth which engage with the teeth of the corresponding pinion gear unit, wherein the storage part is moved by rotating the pinion gear units along the rack gear units engaging with the pinion gear units provided on the opposite sides, so that both sides of the storage part move at the same speed.

The sliding apparatus may further include rotary bodies provided on the opposite sides of the storage part, each of the rotary bodies having a shape of a rotary wheel; a rotary toothed part provided on an outer circumference of each of the rotary bodies, and protruding in a shape of gear teeth; a coupling bar rotatably provided on a side of the storage part in such a way as to protrude to opposite sides, and coupling the rotary bodies to each other; fixed bodies provided on the opposite sides of the main body, and positioned to be in contact with the outer circumferences of the respective rotary bodies; a fixed toothed part provided on a surface of each of the fixed bodies, and protruding in a shape of gear teeth to engage with the rotary toothed part; and at least one stop toothed part provided between teeth of the fixed toothed part, and having a size which is larger than the teeth of the fixed toothed part and allows the rotary toothed part to rotate and pass the stop toothed part when a force is imparted by a user, wherein the rotary bodies are rotatably moved when the storage part moves, by engagement of the rotary toothed part provided on the outer circumference of each of the rotary bodies and the fixed toothed part, so that both sides of the storage part move at the same speed, and the stop toothed part is provided at least one desired position between the teeth of the fixed toothed part engaging with the rotary toothed part, so that each of the rotary bodies rotated by movement of the storage part is stopped by the stop toothed part to be maintained in a stopped state and is rotatably moved by a user's force.

The sliding member may slidably couple the main body with the storage part is obliquely provided to move in a closing direction from an open side of the storage part by gravity, the fixed body may be obliquely arranged according to an inclination of the storage part which is moved by the sliding member in a closing direction because of gravity, and the fixed body may be obliquely arranged at the same angle as a moving angle of the storage part, so that an engagement between the rotary toothed part provided on the outer circumference of the rotary body which rotatably moves along with the storage part and the fixed toothed part is maintained.

Further, in order to accomplish the above object, the present invention provides a sliding apparatus with a self-closing means, having a movable rail provided on each of opposite sides of a storage part, a fixed rail provided on a main body and coupled to the movable rail via a sliding member in such a way as to be in rolling contact with the movable rail, and a rack unit provided on each of the opposite sides of the storage part through gear coupling in such a way as to move the storage part at the same speed, the sliding apparatus including a drive part provided on each of the opposite sides of the storage part and protruding towards the rack unit; a rack body provided at a position of the main body to engage with the storage part, and having a body closing space formed through a portion of the rack body to which the drive part is latched; a gear protrusion protruding from an inner surface of the rack body, and having on a surface thereof a rack gear to engage with the storage part; and a self-closing unit provided in the rack body, disposed in the closing space, and latching the drive part when the storage part moves, thus performing a self-closing operation, wherein the drive part moves along with the storage part when the storage part is pulled out or pushed in, and drives the self-closing unit to perform the self-closing operation, and the self-closing unit is provided in the rack body placed in an operating distance of the storage part to adjust a self-closing distance within the operating distance of the storage part.

The self-closing unit may include a closing guide means provided in the rack body in such a way as to be located at a position in the body closing space, having a closing linear part which is provided on a central portion of the closing guide means to extend from a closed position to an opened position of the storage part, and has a shape of a straight line, and a closing curved part which is provided on an end of the closing linear part placed in an opening direction, is bent downwards, and has a shape of a curve; a closing movable latching part provided in the rack body, located in the body closing space to be guided along the closing guide means, and having a closing latching depression at a position where the drive part moves, thus latching the drive part; and a closing elastic member elastically coupling the rack body with the closing movable latching part, wherein the closing movable latching part is guided along the closing guide means while being elastically coupled to the closing elastic member, thus automatically closing the storage part by an elastic force, and the closing movable latching part is guided to the closing curved part when the closing movable latching part moves in the opening direction of the storage part, so that a portion of the closing latching depression placed in the opening direction of the storage part moves downwards and thus the drive part is released, and the closing movable latching part is latched to the closing latching depression located at the closing curved part when the storage part is opened and then moved in a closing direction, thus performing a self-closing operation by the elastic force of the closing elastic member.

A closing elastic deformation hole may be formed at a position of the rack body to communicate with the body closing space, thus allowing the closing guide means to be elastically deformed in a closed position.

The sliding apparatus may further include a support damper provided in the rack body in such a way as to be in contact with a portion of the closing movable latching part located in the closing direction of the storage part, the support damper absorbing some of the elastic force when the closing movable latching part is moved by the elastic force of the closing elastic member, thus achieving a smooth operation.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF SPECIFIC EMBODIMENTS

Figure 1:
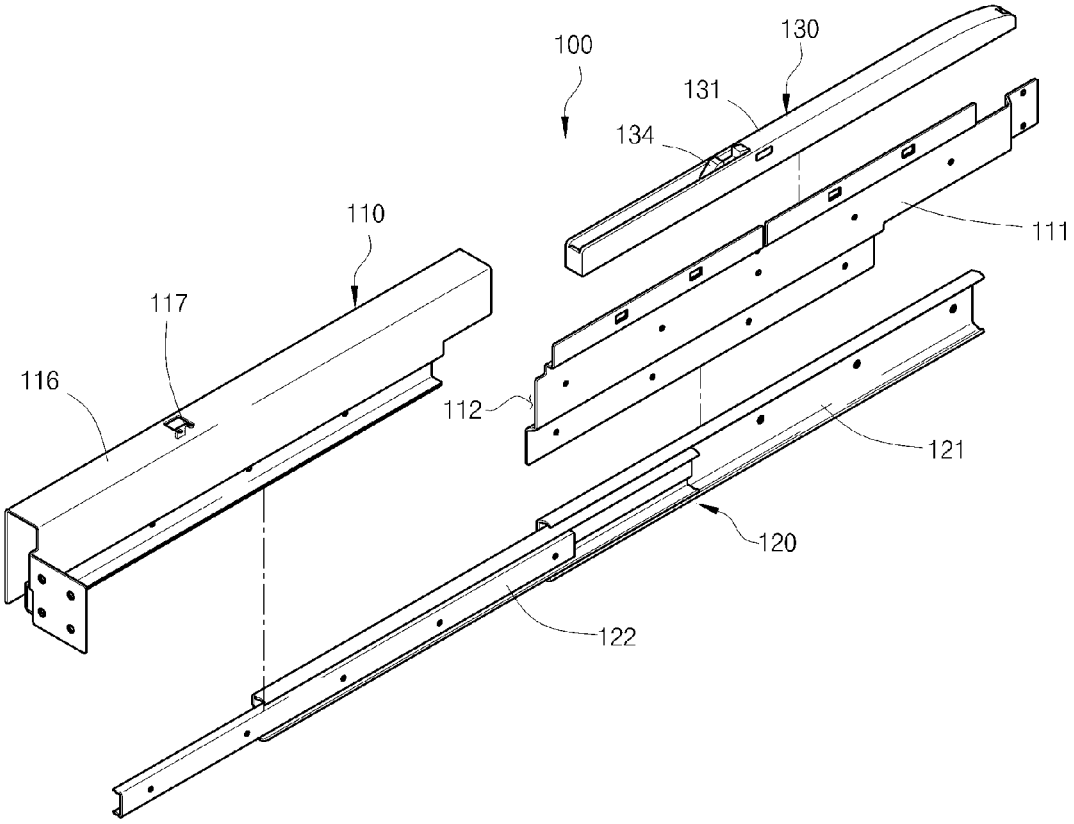
FIG. 1 is an exploded perspective view showing a sliding apparatus with a self-closing means, according to a first embodiment of the present invention.

Hereinafter, the preferred embodiments of the present invention will be described in detail with reference to the accompanying drawings so that those skilled in the art can easily carry out the invention. However, the present invention is not limited to the embodiments but may be realized in various ways. The same reference numerals are used throughout the different drawings to designate the same or similar components.

A sliding apparatus with a self-closing means according to the first embodiment of the present invention will be described below with reference to FIGS. 1 to 5.

Figure 2:
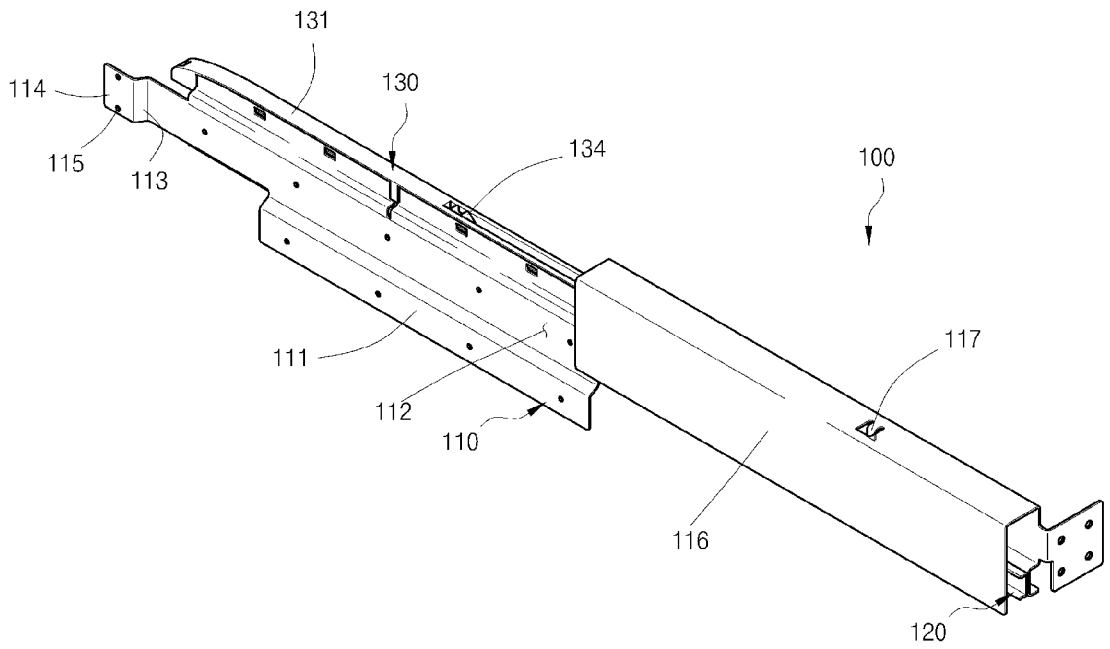
FIG. 2 is a back perspective view showing the sliding apparatus with the self-closing means of FIG. 1.
Figure 3:
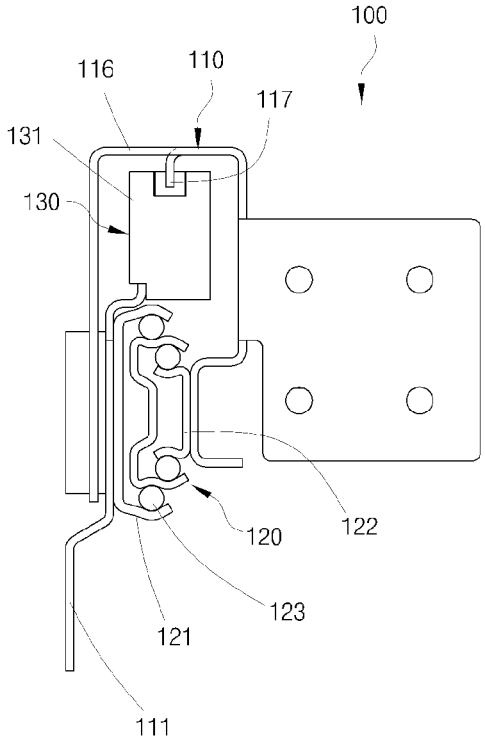
FIG. 3 is a front view showing the sliding apparatus with the self-closing means of FIG. 1.
Figure 4:
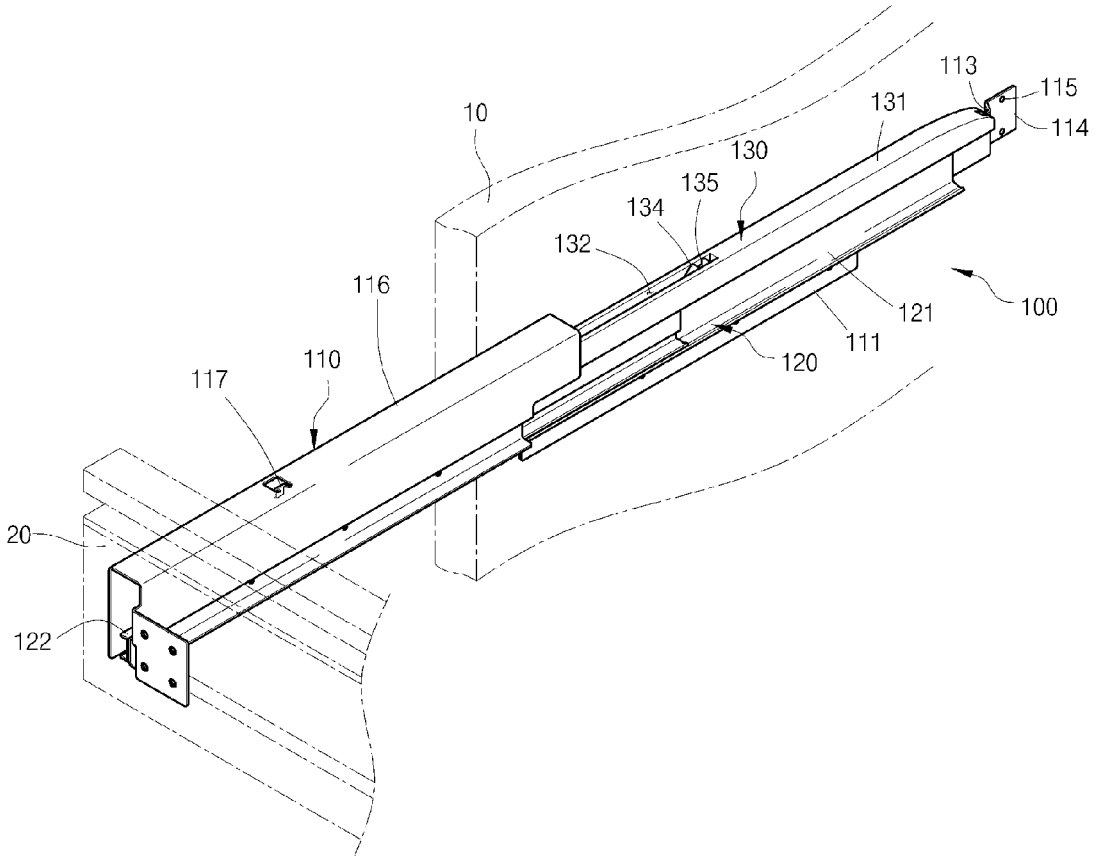
FIG. 4 is a view showing the state in which the sliding apparatus with the self-closing means of FIG. 1 is mounted to a main body and a storage part.
Figure 5:
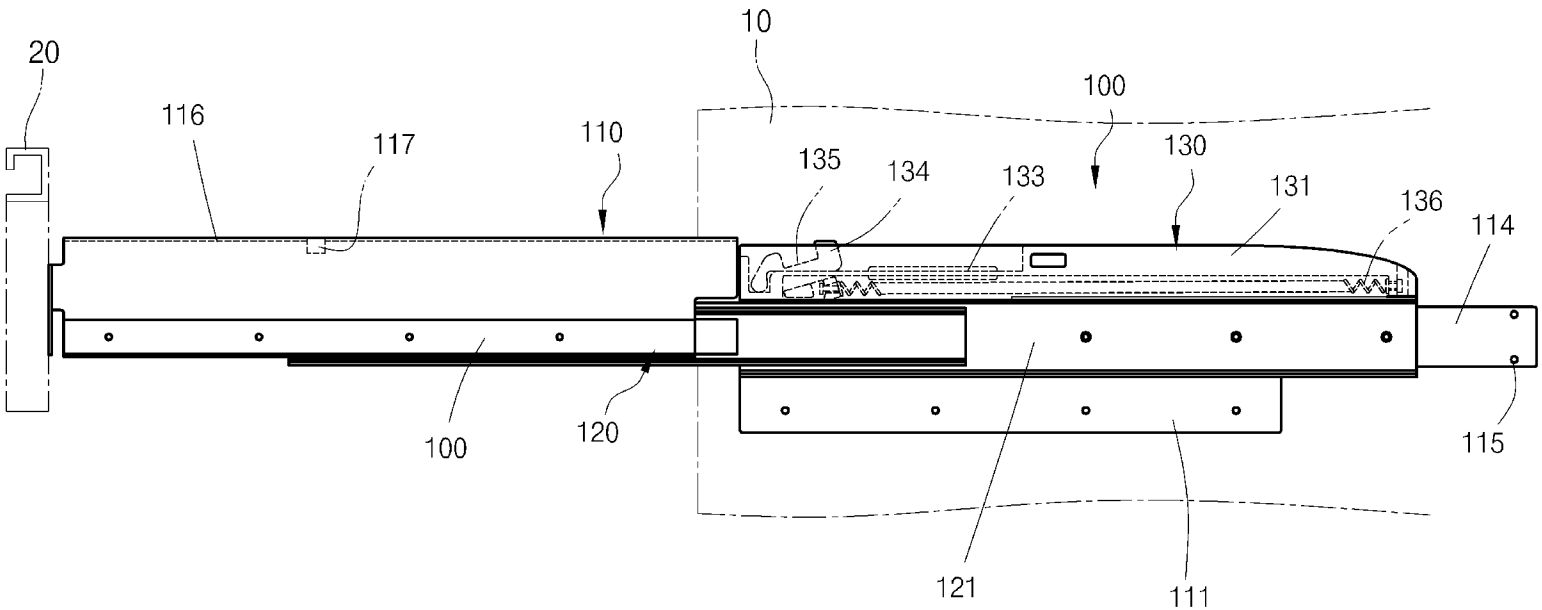
FIG. 5 is a side view showing the state in which the sliding apparatus with the self-closing means of FIG. 1 is mounted.

FIG. 1 is an exploded perspective view showing a sliding apparatus with a self-closing means, according to a first embodiment of the present invention, FIG. 2 is a back perspective view showing the sliding apparatus with the self-closing means of FIG. 1, FIG. 3 is a front view showing the sliding apparatus with the self-closing means of FIG. 1, FIG. 4 is a view showing the state in which the sliding apparatus with the self-closing means of FIG. 1 is mounted to a main body and a storage part, and FIG. 5 is a side view showing the state in which the sliding apparatus with the self-closing means of FIG. 1 is mounted.

Referring to FIGS. 1 to 5, the sliding apparatus 100 with the self-closing means according to the first embodiment of the present invention is installed between a storage part 20 and a main body 10 such that the storage part 20 slides relative to the main body 10 to be pulled out or pushed in, and includes a rail support 110, a rail unit 120, and a self-closing means 130. Further, the direction in which the storage part 20 is pulled out is defined as the opening direction, while the direction in which the storage part 20 is pushed in is defined as the closing direction. These definitions make the positions of the components clearer.

The rail support 11 includes a rail bracket 111 which is provided on each of opposite sides of the main body 10 to which the storage part 20 is slidably coupled, a fastening extension part 114, a fastening means 115, a cover 116, and a drive part 117. The rail brackets 111 are provided on the opposite sides of the main body 10 in such a way as to correspond to the sliding position of the storage part 20. A cover space 112 is defined in each rail bracket 111 towards the main body 10 in such a way as to be spaced apart from the main body 10. A fastening bent part 113 is provided on an end of the rail bracket 111 in such a way as to be positioned at the inner end of the main body 10, and is bent towards the cover space 112 to make contact with the main body 10. The fastening bent part 113 is bent and is in contact with the main body 10 to fasten the rail bracket 111 thereto, with the rail bracket 111 forming the cover space 112.

The fastening extension part 114 is provided at a position where the fastening bent part 113 is in contact with the main body 10, and extends to the inner portion of the main body 10, the extended surface coming into contact with the main body 10. The fastening extension part 114 may be in contact with the main body 10, while it and the fastening bent part 113 form the cover space 112.

The fastening means 115 is provided to fasten the fastening extension part 114 to the main body 10. By fastening the fastening extension part 114 to the main body 10 using the fastening means 115, the rail bracket 111 may be secured to the main body 10. The fastening means 115 may include all means for fastening the fastening extension part 114 to the main body 10, for example, a bolt or a rivet.

The cover 116 is provided on each of opposite sides of the storage part 20 to surround the rail unit 120. The cover 116 extends downwards from each of opposite sides of the upper portion of the storage part 20 in such a way as to be spaced apart from the storage part 20, thus surrounding the rail unit 120. The cover 116 is placed such that it surrounds the opposite sides of the rail unit 120 when the cover 116 moves along with the storage part 20 and thus the storage part 20 opens, and it is received in the cover space 112 to surround the rail unit 120 and the rail bracket 111 when the storage part 20 is closed. The cover 116 prevents the rail unit 120 from being exposed to the outside when the storage part 20 opens, thus protecting the rail unit 120 from external shock, and improving an appearance. Further, when the storage part 20 is closed, the cover 116 surrounds the rail unit 120 and the rail bracket 111, thus preventing the permeation of moisture caused by the internal environment of the main body 10. Especially in the case of a refrigerator, the cover 116 prevents drops of water caused by condensation in the main body 10 of the refrigerator from entering the rail bracket 111 and the rail unit 120, thus preventing the sliding operation from being interfered with by frost. Herein, the cover 116 is secured to each of the opposite sides of the storage part 20 in such a way as to extend from an upper position to a lower position. However, this is only one example provided for the sake of description. The cover 116 includes all shapes that may surround the respective components of the sliding apparatus 100. That is, the cover 116 may extend from an edge of the storage part 20, or may be manufactured as a separate component using metal or white plastic and then be attached to the storage part 20.

The drive part 117 is provided at a position on the upper portion of the cover 116 in such a way as to protrude towards the self-closing means 130, and moves along with the storage part 20 to operate the self-closing means 130. The drive part 117 is provided at a predetermined position of the cover 116 which moves along with the storage part 20, and protrudes towards the self-closing means 130. When the storage part 20 is closed, the drive part 117 moves along with it and is latched by the self-closing means 130, so that the storage part 20 can be automatically closed. Meanwhile, when the storage part 20 opens, the drive part 117 is released from the self-closing means 130, so that the storage part 20 can be opened. That is, the drive part 117 is provided on the cover 116 which moves along with the storage part 20 in such a way as to protrude towards the self-closing means 130, thus operating the self-closing means 130 when the storage part 20 is pushed in or pulled out.

The rail unit 120 includes a fixed rail 121 at a position of the main body 10 to which the storage part 20 is slidably coupled, a movable rail 122, and a sliding member 123. The fixed rail 121 is positioned in the main body 10, and is secured to the rail bracket 111. The fixed rail 121 is located at the position where the storage part 20 is slidably coupled, and is secured to the rail bracket 111. The fixed rail 121 is secured to the main body 10 via the rail bracket 111 to allow the storage part 20 to be slidably coupled to the main body 10.

The movable rail 122 is provided on each of the opposite sides of the storage part 20, and is slidably coupled to the fixed rail 121. The movable rail 122 is provided on each of the opposite sides of the storage part 20, and is slidably moved along the fixed rail 121. The movable rail 122 is slidably coupled to the fixed rail 121 and thus moves along with the storage part 20.

The sliding member 123 is provided between the fixed rail 121 and the movable rail 122, and performs a sliding coupling operation such that the movable rail 122 rolls on the fixed rail 121. The sliding member 123 is placed to perform a rolling movement when the movable rail 122 slides along the fixed rail 121. Herein, the sliding member 123 has the form of a ball, but it is only one example provided for the sake of description. The sliding member 123 includes all means for rolling the movable rail 122 on the fixed rail 121. That is, it is obvious to those skilled in the art that the sliding member 123 may use a ball or a roller which performs a rolling movement, and the shape of the fixed rail 121 and the movable rail 122 may be changed depending on the shape of the sliding member 123.

The self-closing means 130 includes a closing housing 131 which is placed above the fixed rail 121, a guide means 133, a movable latching part 134, and an elastic member 136. The closing housing 131 is provided on each of the opposite sides of the rail brackets 111 and placed on top of the fixed rail 121. The closing housing 131 is installed at a position where the drive part 117 moving along with the storage part 20 is latched. The closing housing 131 may be installed such that its position is adjusted according to the position where the self-closing operation is performed. That is, since the self-closing means 130 is placed at an upper position where the sliding of the movable rail 122 for sliding the storage part 20 is not interfered with, the position of the closing housing 131 may be adjusted according to a desired position of the self-closing operation. A closing space 132 is formed in the closing housing 131 in such a way as to pass vertically through the closing housing 131. The closing space 132 is formed at a position into which the drive part 117 is inserted when the storage part 20 moves, and the size of the closing space 132 may be adjusted according to the length of a self-closing operating section. That is, the closing space 132 has a size corresponding to the length of the self-closing operating section of the storage part 20, so that the size of the closing space 132 may be adjusted according to a desired operating distance, so that it is possible to adjust the distance of the self-closing operating section.

The guide means 133 is provided at a position in the closing space 132 to guide the movable latching part 134. The guide means 133 is provided at a position in the closing space 132, and has a linear part **133*a* which has the shape of a straight line and extends from a center of the closing direction in the opening direction of the storage part 20, and a curved part 133*b* which is provided on an end of the linear part 133*a* in the opening direction and is bent downwards. The guide means 133 guides the drive part 117 latched by the movable latching part 134 to the linear part 133*a* when the storage part 20 moves from the closed state in the opening direction, and moves a front portion of the movable latching part 134, located in the opening direction, downwards along the curved part 133*b* when the drive part 117 passes the linear part 133*a* and reaches the curved part 133*b*, so that the movable latching part 134 is tilted and thus the drive part 117 is released from the movable latching part 134**.

Further, when the open storage part 20 is closed again, the guide means 133 functions to guide the drive part 117 such that it is latched by the movable latching part 134 while moving in the closing direction, and is moved from the curved part 133*b* to the linear part 133*a*.

An elastic deformation hole 133*c* is formed in a surface of the closing housing 131 in such a way as to be located at the linear part 133*a* of the guide means 133 in the closing direction. The linear part 133*a* of the guide means 133 is elastically deformed in the elastic deformation hole 133*c* so that the sliding apparatus 100 is restored from a malfunction state to the original state thereof.

The movable latching part 134 is positioned in the closing housing 131 and installed to be guided along the guide means 133. The movable latching part 134 is positioned in the open upper portion of the closing space 132, and is coupled to the guide means 133 to move along the linear part 133*a* and the curved part 133*b*. A latching depression 135 is formed in the upper portion of the movable latching part 134 to latch the drive part 117. When the storage part 20 is in the closed position, the drive part 117 is inserted into and latched by the latching depression 135. When the storage part 20 moves from the closed to the open position, the movable latching part 134 latched by the drive part 117 is guided to the linear part 133*a* of the guide means 133 and moved in the opening direction. When the movable latching part 134 moves and reaches the curved part 133*b* of the guide means 133, the front portion of the movable latching part 134 located in the opening direction of the storage part 20 moves downwards, and the front portion of the latching depression 135 located in the opening direction moves downwards, so that the drive part 117 is released from the movable latching part 134. Thereby, the storage part 20 moves out of the self-closing operating section, so that the opening operation is conducted. When the storage part 20 has been opened and thereafter moves to the closed position, the drive part 117 is latched by the latching depression 135, so that the movable latching part 134 is guided from the curved part 133*b* to the linear part 133*a* of the guide means 133 and moved in the closing direction.

Herein, the guide means 133 shown in the drawings has the shape of a projection, and the movable latching part 134 is shaped to be inserted into the projection. The elastic deformation hole 133*c* is formed to open the linear part, thus allowing the projection-shaped guide means 133 to move. However, it is only one example provided for the sake of description. That is, the guide means 133 may include all means for guiding the movable latching part 134. Furthermore, the movable latching part 134 which is movably guided along the guide means 133 and the elastic deformation hole 133*c* in which the guide means 133 is elastically deformed may change depending on the means of guiding. In other words, the guide means 133 may have the shape of a projection or a hole, the movable latching part 134 may be provided with a projection which is inserted into the hole, and the elastic deformation hole 133*c* may be formed to partially communicate with the hole.

The elastic member 136 connects the movable latching part 134 to the closing housing 131, and is supported on the portion of the movable latching part 134 located in the closing direction of the storage part 20 and the portion of the closing housing 131 located in the closing direction. If the storage part 20 moves from the closed state to the open state, the elastic member 136 connected to the movable latching part 134 is stretched, thus providing elastic force to the movable latching part 134. When the movable latching part 134 is inserted into the curved part 133*b* to be supported, the elastic member 136 maintains its stretched state. When the storage part 20 opens and thereafter moves in the closing direction, the movable latching part 134 moves from the curved part 133*b* to the linear part 133*a*, so that the self-closing operation is performed by the elastic force of the stretched elastic member 136. Thus, the elastic member 136 applies elastic force so that the storage part 20 can be automatically closed.

The operation of the sliding apparatus with the self-closing means according to the first embodiment of the present invention will be described below with reference to FIGS. 6 to 9.

Figure 6:
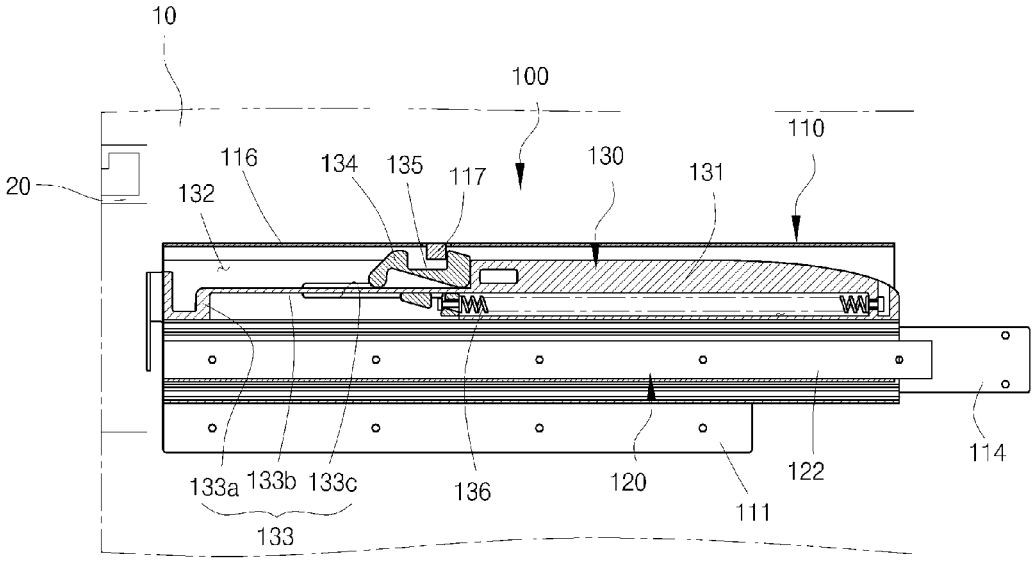
FIG. 6 is a view showing the state in which the storage part having the sliding apparatus with the self-closing means of FIG. 1 is closed.
Figure 7:
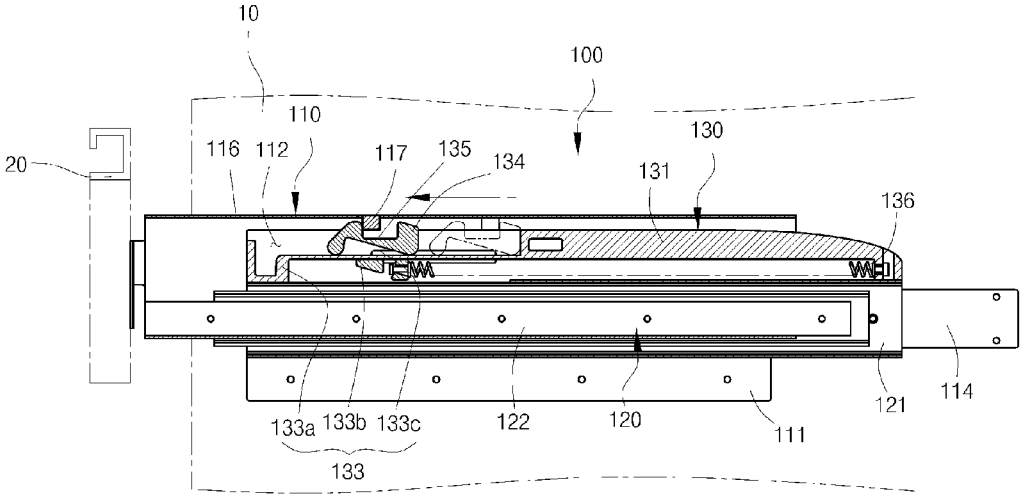
FIG. 7 is a view showing the state in which the storage part having the sliding apparatus with the self-closing means of FIG. 1 is being opened.
Figure 8:
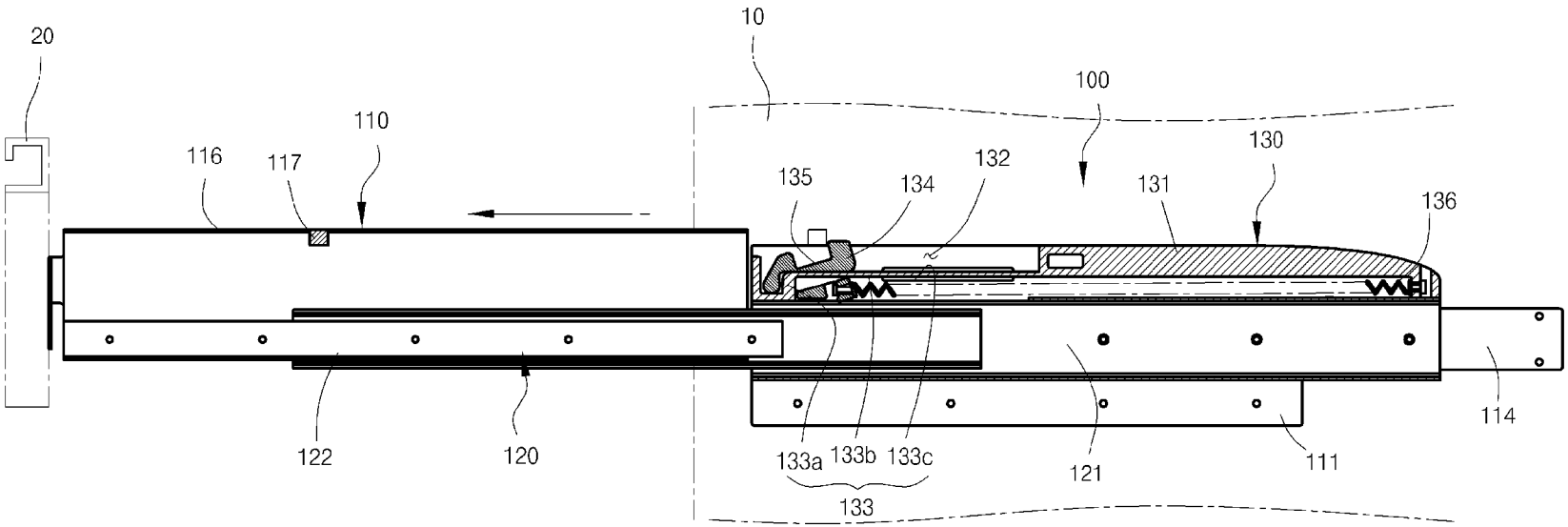
FIG. 8 is a view showing the state in which the storage part having the sliding apparatus with the self-closing means of FIG. 1 has been opened.
Figure 9:
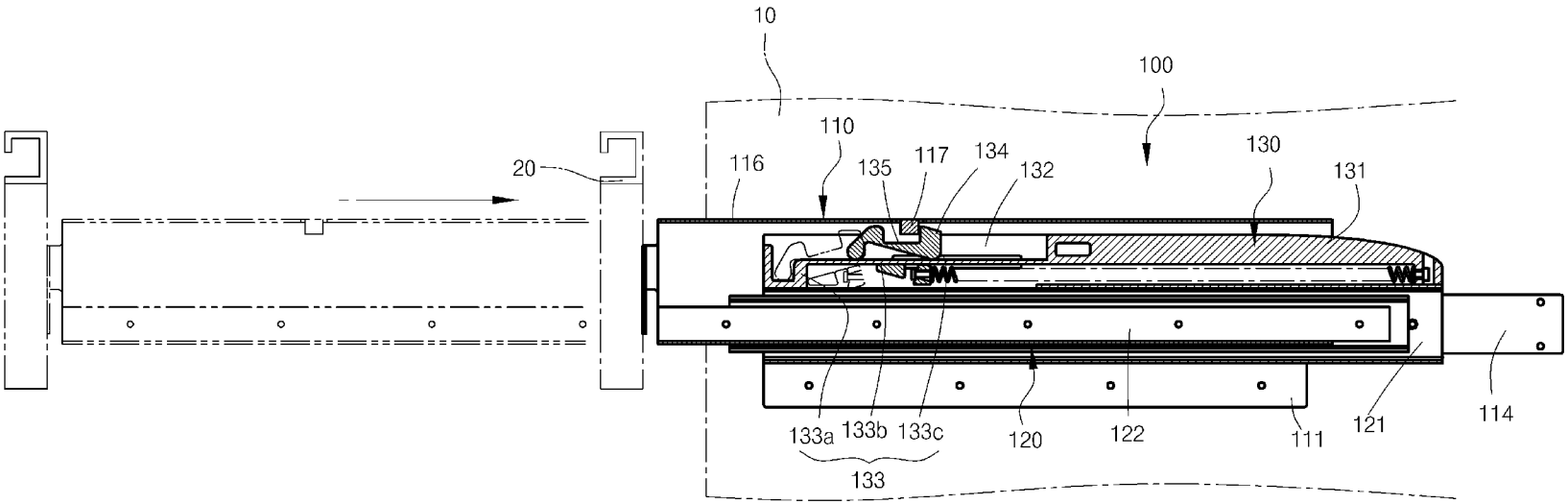
FIG. 9 is a view showing the state in which the storage part having the sliding apparatus with the self-closing means of FIG. 1 is automatically closed.

FIG. 6 is a view showing the state in which the storage part having the sliding apparatus with the self-closing means of FIG. 1 is closed, FIG. 7 is a view showing the state in which the storage part having the sliding apparatus with the self-closing means of FIG. 1 is being opened, FIG. 8 is a view showing the state in which the storage part having the sliding apparatus with the self-closing means of FIG. 1 has been opened, and FIG. 9 is a view showing the state in which the storage part having the sliding apparatus with the self-closing means of FIG. 1 is automatically closed.

Referring to FIG. 6, when the storage part 20 is in the closed position, the cover 116 surrounds the fixed rail 121 which is secured to the rail bracket 111 while being inserted into the cover space 112 and the movable rail 122 fitted into the self-closing means 130 and the fixed rail 121. The cover 116 is positioned in the main body 10 to surround the rail bracket 111, the fixed rail 121, the self-closing means 130, and the movable rail 122, thus preventing contaminants and moisture from entering the main body 10. Especially in the case of a storage part 20 used in a refrigerator, the cover prevents drops of water caused by condensation from entering the rail unit 120 and the self-closing means 130, therefore preventing the formation of frost that would interfere with the sliding and self-closing operation. The drive part 117 provided at a predetermined position of the cover 116 is located in the rear portion of the linear part 133*a* of the guide means 133 located in the closing direction of the storage part 20 while being latched by the latching depression 135 of the movable latching part 134.

Referring to FIG. 7, when the storage part 20 moves from the closed position to the open position, the movable rail 122 moves in the opening direction and the cover 116 also moves in the opening direction. As the cover 116 moves, the drive part 117 provided at a predetermined position of the cover 116 moves along with the movable latching part 134 in the opening direction, while being inserted into the latching depression 135. As the movable latching part 134 moves in the opening direction, the elastic member 136 elastically connected to the closing housing 131 is stretched. The movable latching part 134 may be guided along the linear part 133*a* to move toward the curved part 133*b*, with the drive part 117 inserted into the latching depression 135.

Referring to FIG. 8, as the storage part 20 is continuously moved in the opening direction, the movable latching part 134 is moved to the curved part 133*b* by the drive part 117, while the cover 116 surrounds the movable rail 122, and the movable latching part 134 which has moved is rotatably moved along the curved part 133*b*. As the movable latching part 134 moves in the opening direction, the front portion of the movable latching part 134 located in the opening direction tilts downwards along the curved part 133*b*. If the front portion of the movable latching part 134 is tilted downward, the front portion of the latching depression 135 located in the opening direction opens. When the front portion of the latching depression 135 opens, the drive part 117 is released from the latching depression 135, so that the storage part 20 may be operated and open. Here, the elastic member 136 elastically coupling the movable latching part 134 with the closing housing 131 stays in the stretched state, as the movable latching part 134 is guided along the curved part 133*b*, to then be stopped. Further, when the storage part 20 opens, the cover 116 provided on each of the opposite sides of the storage part 20 prevents the movable rail 122 from being exposed to the outside, thus providing a good appearance, and preventing the movable rail 122 from being broken by external force.

Referring to FIG. 9, when the storage part 20 moves from the open position to the closed position, the cover 116 is inserted into the cover space 112 and the drive part 117 is inserted into the latching depression 135. If the drive part 117 is inserted into the latching depression 135, the movable latching part 134 moves from the curved part 133*b* to the linear part 133*a* of the guide means 133, so that the front portion of the latching depression 135 located in the opening direction moves upwards, so that the drive part 117 is latched by the latching depression 135. As the movable latching part 134 moves to the linear part 133*a* of the guide means 133, it is automatically moved in the closing direction by the elastic force of the stretched elastic member 136, and the storage part 20 is automatically closed in the closing direction together with the cover 116.

If external force acts on the movable latching part 134 located in the curved part 133*b*, or an opening operation is performed in the state in which the movable latching part 134 is not completely moved to the curved part 133*b*, the sliding apparatus 100 with the self-closing means may be moved in the closing direction by the elastic force of the elastic member 136 and thus may malfunction so that the self-closing operation is not performed.

Figure 10:
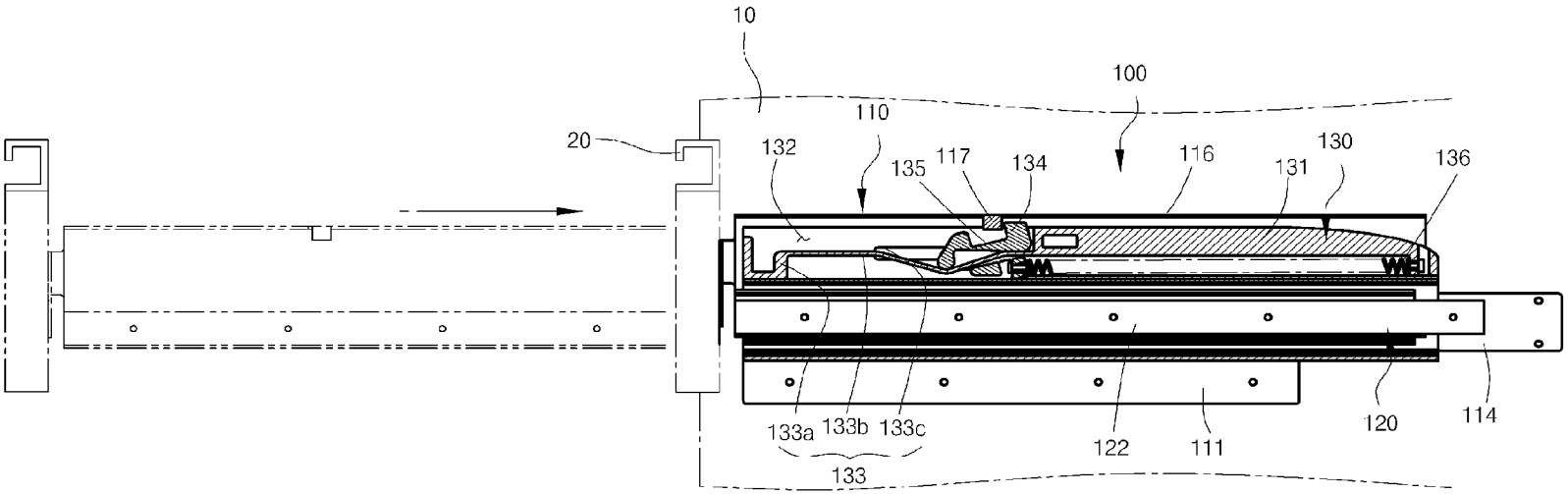
FIG. 10 is a view showing the state in which the sliding apparatus with the self-closing means of FIG. 1 is restored to the original state thereof.

The aforesaid malfunction may revert to the original state by forcibly closing the storage part 20, as shown in FIG. 10.

When the storage part 20 is forcibly closed in the state in which the movable latching part 134 is located at a portion of the linear part 133*a* of the guide means 133 placed in the closing direction because of the malfunction, the drive part 117 provided on the cover 116 moves to the movable latching part 134. If the drive part 117 reaches the movable latching part 134, the drive part 117 comes into contact with the front portion of the movable latching part 134 located in the opening direction and is inserted into the latching depression 135. Here, the linear part 133*a* of the guide means 133 into which the movable latching part 134 is inserted may be elastically deformed by the elastic deformation hole 133*c*. That is, a pushing force of the drive part 117 is generated to push the movable latching part 134 downwards, and the linear part 133*a* of the guide means 133 located in the elastic deformation hole 133*c* moves downwards because it deforms elastically while the drive part 117 is latched by the latching depression 135. When the storage part 20 moves in the opening direction in the state in which the drive part 117 is latched by the latching depression 135 formed in the upper portion of the movable latching part 134, the movable latching part 134 is inserted into the curved part 133*b* again and the elastic member 136 is stretched, that is, is put in a normal operating state, so that the self-closing means 130 is restored to its original state to perform the self-closing operation and thus can be repetitively operated.

Further, a sliding apparatus with a self-closing means according to the second embodiment of the present invention will be described below with reference to FIGS. 11 and 12.

Figure 11:
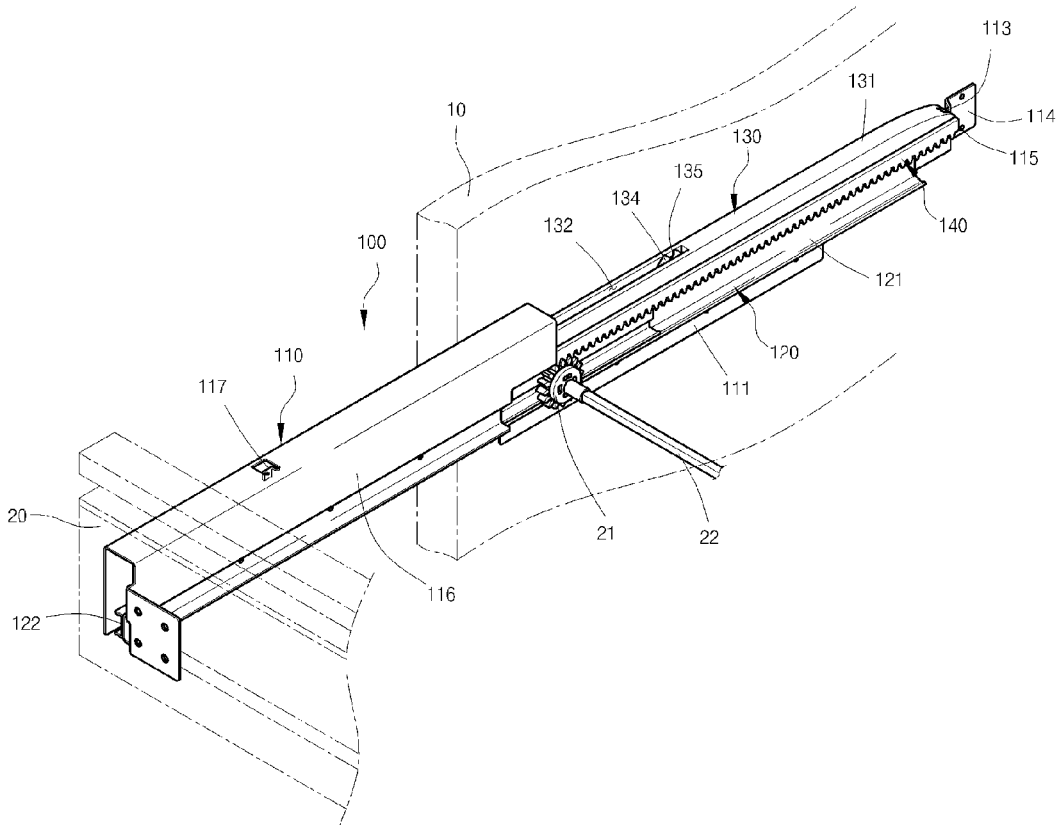
FIG. 11 is a view showing the state in which a sliding apparatus with a self-closing means according to a second embodiment of the present invention is mounted.
Figure 12:
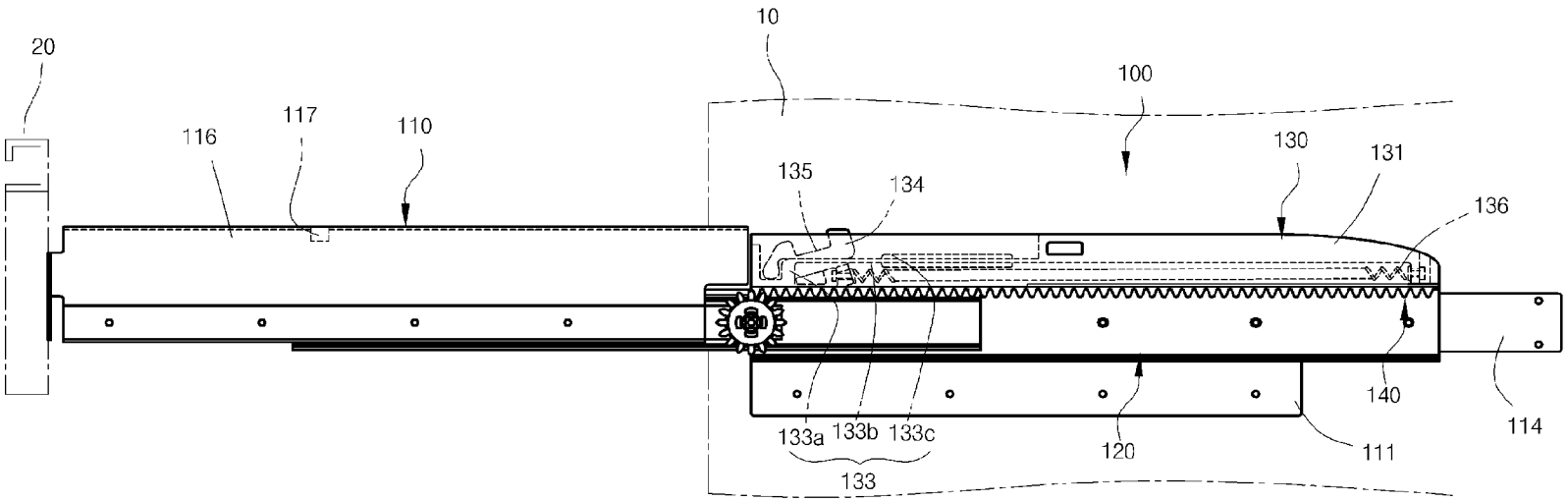
FIG. 12 is a side view showing the state in which the sliding apparatus with the self-closing means of FIG. 11 is mounted.

FIG. 11 is a view showing the state in which a sliding apparatus with a self-closing means according to a second embodiment of the present invention is mounted, and FIG. 12 is a side view showing the state in which the sliding apparatus with the self-closing means of FIG. 11 is mounted.

As shown in FIGS. 11 and 12, the sliding apparatus 100 with the self-closing means according to the second embodiment of the present invention is installed between a main body 10 and a storage part 20, and includes a rail support 110, a rail unit 120, a self-closing means 130, and a rack gear unit 140. Since the rail support 110, the rail unit 120, and the self-closing means 130 are substantially identical with the components of the sliding apparatus 100 with the self-closing means shown in FIGS. 1 to 5, a detailed description will be omitted.

Wheel-shaped pinion gear units 21 each having teeth on the outer circumference thereof are provided on the opposite sides of the storage part 20. Each pinion gear unit 21 is coupled to a coupling bar 22 which is rotatably supported on the storage part 20. That is, the pinion gear units 21 provided on the opposite sides of the storage part 20 are coupled by the coupling bar 22 and are rotatably moved together when the storage part 20 moves.

A rack gear unit 140 which has teeth on its lower portion is provided between the fixed rail 121 and the self-closing means 130. The rack gear unit 140 is secured to each of the opposite surfaces of the rail brackets 111, and engages with each of the pinion gear units 21 provided on the opposite sides of the storage part 20. The pinion gear units 21 each engaging with the rack gear unit 140 are coupled by the coupling bar 22 which is rotatably supported by the storage part 20. As the storage part 20 moves, each pinion gear unit 21 is rotatably moved along the rack gear unit 140. As each pinion gear unit 21 provided on each side of the storage part 20 rotatably moves along the rack gear unit 140 engaging with the pinion gear unit 21, both sides of the storage part 20 can be moved at the same speed. Therefore, both sides of the storage part 20 move at the same speed, so that twisting of the storage part 20 resulting from a difference in moving speed between the two sides of the storage part 20 is prevented, thus leading to an increase in the life-span of the storage part 20.

Furthermore, a sliding apparatus with a self-closing means according to the third embodiment of the present invention will be described below with reference to FIG. 13.

Figure 13:
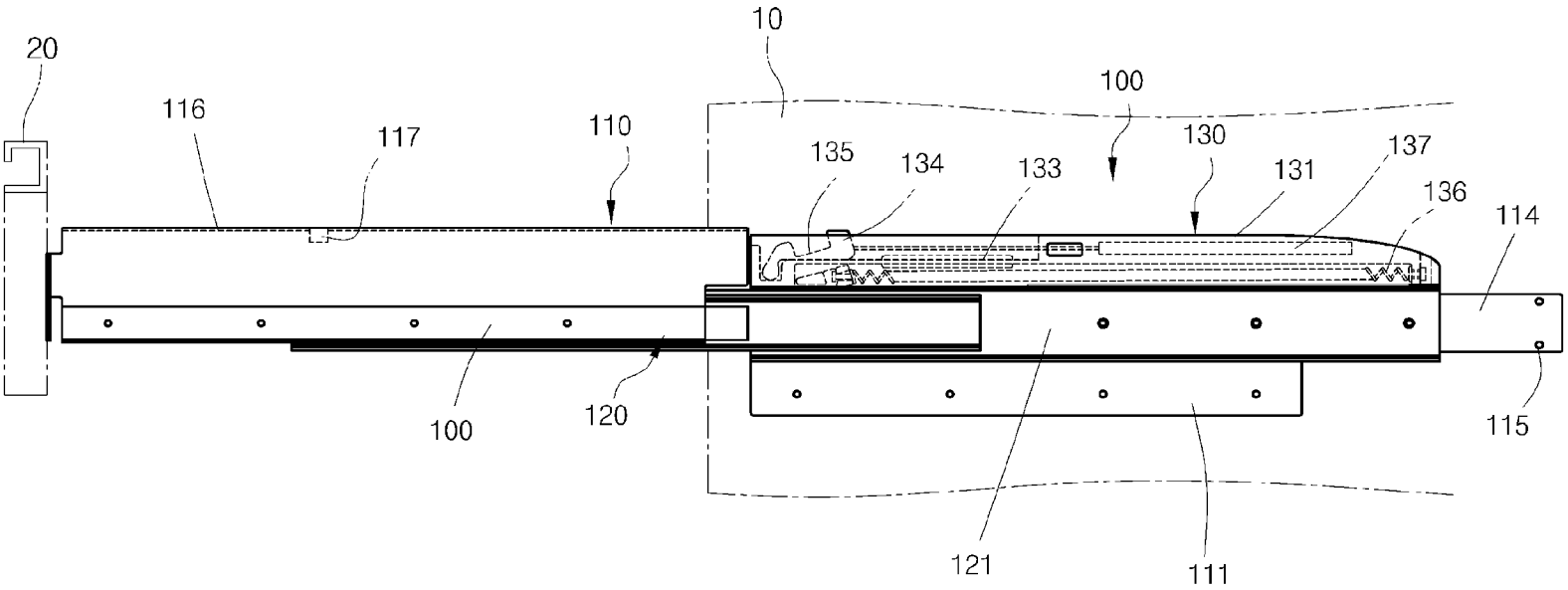
FIG. 13 is a side view showing a sliding apparatus with a self-closing means, according to a third embodiment of the present invention.

FIG. 13 is a side view showing a sliding apparatus with a self-closing means, according to a third embodiment of the present invention.

Referring to FIG. 13, the sliding apparatus 100 with the self-closing means according to the third embodiment of the present invention includes a rail support 110, a rail unit 120, and a self-closing means 130. Since the rail support 110, the rail unit 120, and the self-closing means 130 are substantially identical with the components of the sliding apparatus 100 with the self-closing means shown in FIGS. 1 to 5, a detailed description will be omitted.

The self-closing means 130 may further include a damper 137 which is provided in a closing housing 131 and is in contact with a rear portion of a movable latching part 134 located in the closing direction of the storage part 20. The damper 137 absorbs some of elastic force in the closing direction of the movable latching part 134 which is automatically closed by the elastic force of an elastic member 136, thus allowing the storage part 20 to open smoothly.

Herein, the damper 137 is a general damper which is capable of lessening shock using a fluid such as oil, and a detailed description thereof will be omitted.

Further, a sliding apparatus with a self-closing means according to the fourth embodiment of the present invention will be described below with reference to FIG. 14.

Figure 14:
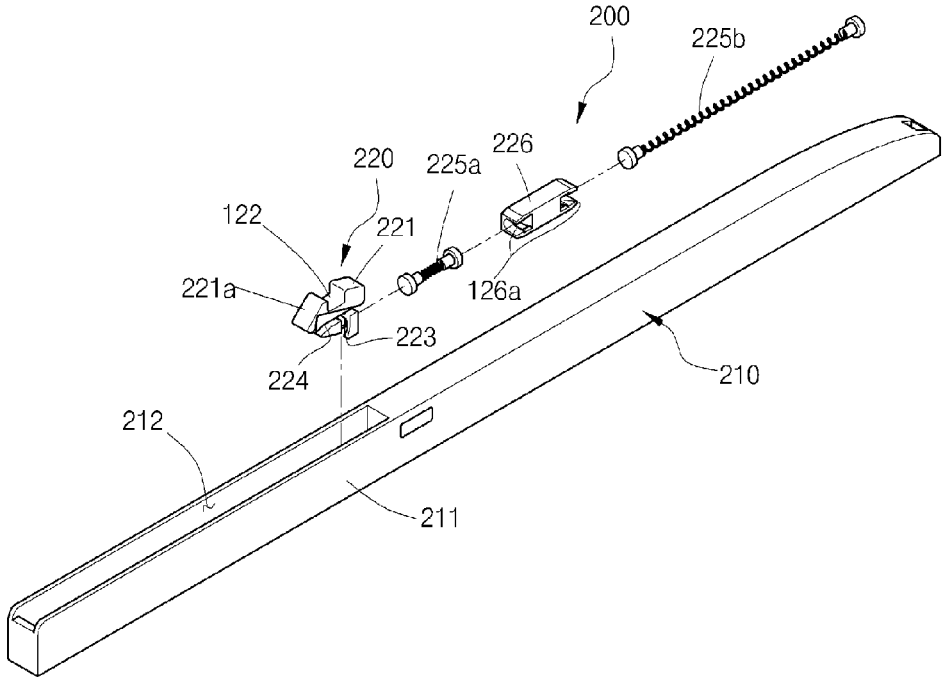
FIG. 14 is an exploded perspective view showing a sliding apparatus with a self-closing means, according to a fourth embodiment of the present invention.

FIG. 14 is an exploded perspective view showing a sliding apparatus with a self-closing means, according to a fourth embodiment of the present invention.

Referring to FIG. 14, since the sliding apparatus 100 with the self-closing means according to the fourth embodiment of the present invention is equal to the sliding apparatus 100 with the self-closing means shown in FIGS. 1 to 5 except for the self-closing means, this same construction will be omitted in the drawing and description.

The self-closing means 200 includes a body unit 210 which is provided on each of opposite sides, and a latching unit 220. The body unit 210 includes a closing body 211 which is provided on each of the opposite sides of the main body 10, and a guide wall 213. The closing body 211 is provided on the main body 10 in such a way as to be placed on the upper portion of the sliding apparatus 100, with a body space 212 defined in a predetermined portion of the closing body 211 in such a way as to pass vertically through the closing body 211. The closing body 211 is placed on the upper portion of the sliding apparatus 100 to allow a drive part 117 to be inserted therein, and has the body space 212 into which the drive part 117 is inserted. The latching unit 220 is provided in the body space 212, and latches the inserted drive part 117 to perform a self-closing operation. The drive part 117 moving along with the storage part 20 and the closing body 211 provided to allow the drive part 117 to be automatically closed are not moved along the opposite surfaces of the sliding apparatus 100, but move along the upper portion of the sliding apparatus 100 to perform the self-closing operation. Thus, the self-closing means 200 may be installed while its position is adjusted according to a desired position of the self-closing operation.

The guide wall 213 is provided in the closing body 211, and extends from one end to the other end of the body space 212. The guide wall 213 has a linear guide part 213*a* which has the shape of a straight line and extends from a center of the closing direction in the opening direction of the storage part 20, and a curved guide part 213*b* which is provided on an end of the linear guide part 213*a* in the opening direction and is bent downwards. The latching unit 220 is positioned in the body space 212 and inserted into the guide wall 213 to be guided therealong. The latching unit 220 is located at a position where the drive part 117 moving on the upper portion of the body space 212 is latched or released to perform the self-closing operation.

Further, a through hole 215 is formed in the rear portion of the linear guide part 213*a* of the guide wall 213 located in the closing direction of the storage part 20 so that the linear guide part 213*a* may be elastically deformed in the through hole 215. In malfunction where the latching unit 220 moves to the rear portion of the linear guide part 213*a* located in the closing direction and the self-closing operation is not performed when the storage part 20 is open, if the storage part 20 is forcibly moved in the closing direction, the latching unit 220 presses the linear guide part 213*a* downwards at the position of the through hole 215, and the pressed linear guide part 213*a* is elastically deformed downwards at the position of the through hole 215, so that the latching unit 220 moves downwards. While the drive part 117 is inserted into the latching unit 220 which has moved downwards, the latching unit 220 can be restored to the original state where the self-closing operation is possible.

Further, an elastic-means support recess 214 is formed in the rear portion of the closing body 211 located in the closing direction to elastically support the latching unit 220.

The latching unit 220 includes a latching body 221, an elastic means 225, and a connector 226, which are positioned in the body space 212. The latching body 221 is positioned in the body space 212 which is open at its upper portion, and has in its upper portion a latching depression 222 so that the drive part 117 moving along with the storage part 20 is inserted into the latching depression 222. A guide recess 224 is provided in a side of the latching body 221 so that it is fitted to and guided along the guide wall 213. When the guide wall 213 is inserted into the guide recess 224 and the storage part 20 is closed, the latching body 221 is located at the linear guide part 213*a*. Meanwhile, when the storage part 20 opens, the drive part 117 latched by the latching depression 222 moves along the linear guide part 213*a* to be inserted into the curved guide part 213*b*, so that the front portion of the latching body 221 located in the opening direction of the storage part 20 moves downwards. As the front portion of the latching body 221 moves downwards, the front portion of the latching depression 222 of the latching body 221 located in the opening direction opens, so that the storage part 20 may move in the opening direction. When the closing operation is performed again, the storage part 20 moves and the drive part 117 is latched by the latching depression 222, so that the latching body 221 is movably guided from the curved guide part 213*b* to the linear guide part 213*a*.

Also, the latching body 221 has an inclined surface 221*a* which is inclined upwards from a central portion in the opening direction of the storage part 20 to a portion of the latching depression 222 located in the opening direction. The inclined surface 221*a* minimizes latching interference between the latching depression 222 and the drive part 117 inserted therein, and allows the drive part 117 to be easily inserted into the latching depression 222 when the linear guide part 213*a* is elastically deformed after malfunctioning. That is, in order to minimize the latching interference when the drive part 117 is inserted in an incorrect position, the drive part 117 is inserted through the inclined surface 221*a* into the latching depression 222 of the latching body 221 which moves downwards so that the linear guide part 213*a* is elastically deformed.

Further, an elastic-means coupling recess 223 is formed in the lower portion of an end of the latching body 221 located in the closing direction of the storage part 20 to support one end of the elastic means 225.

The elastic means 225 is elastically coupled between the latching body 221 and the closing body 211, and includes a plurality of elastic members 225*a* and 225*b* which are coupled in series. One end of the elastic means 225 is inserted into the elastic-means coupling recess 223 of the latching body 221, while the other end is supported by the elastic-means support recess 214 of the closing body 211. The elastic means 225 is stretched when the latching body 221 moves in the opening direction from the closed position of the storage part 20, thus providing an elastic force. The elastic means 225 is kept under tension because the latching body 221 is inserted into the curved guide part 213*b* when the storage part 20 is in the open position. When the storage part 20 moves to the closed position with the latching body 221 positioned in the curved guide part 213*b*, the drive part 117 is inserted into the latching depression 222 of the latching body 221, so that the self-closing operation is performed in the closing direction by the elastic force of the stretched elastic means 225.

The elastic means 225 includes a primary elastic member 225*a* and a secondary elastic member 225*b* which have different elastic forces and are coupled in series. The primary and secondary elastic members 225*a* and 225*b* which are coupled in series are stretched when the latching body 221 moves from the closed position to the open position of the storage part 20, thus providing an elastic force. Here, according to tensile force generated when the primary and secondary elastic members 225*a* and 225*b* having different elastic force are stretched, a user can notice the how far they are stretched when the opening operation is being conducted. That is, when storage part 20 opens, both the primary and secondary elastic members 225*a* and 225*b* are simultaneously stretched. Among the primary and secondary elastic members 225*a* and 225*b* which are coupled in series, the elastic member having a smaller elastic force is first stretched to allow the opening operation to be easily performed. When the elastic member having the smaller elastic force finishes stretching during the opening operation, the elastic member having a larger elastic force is stretched, and the latching body 221 is inserted into the curved guide part 213*b*, thus maintaining the stretched state. When the elastic member having the larger elastic force is stretched after the elastic member having the smaller elastic force has been stretched, a larger force is required. Therefore, since the force of pulling the storage part 20 out varies according to a change in elastic force, a user who opens the storage part 20 can notice when the storage part 20 has opened.

In detail, when the primary and secondary elastic members 225*a* and 225*b* coupled in series are pulled out during the opening operation of the storage part 20, a user can notice the open position using an elastic force which varies according to the stretched distance of each elastic member 225*a* or 225*b*. When a user notices the open position, he or she can notice the position where the drive part 117 moving along with the storage part 20 is released from the latching body 221, thus preventing an injury from being caused by the undesirable self-closing operation.

Further, in the closing operation of the storage part 20, the drive part 117 is latched by the latching body 221, and the storage part 20 is automatically closed by the resultant force of the primary and secondary elastic members 225*a* and 225*b* having the different elastic forces. That is, when the elastic means 225 including the primary and secondary elastic members 225*a* and 225*b* which are coupled in series is stretched, the elastic means 225 may be stretched in stages according to the respective elastic forces. In the case of the self-closing operation, the closing operation is performed by the sum of the elastic forces, so that closing efficiency can be improved.

Thus, the elastic means 225 which elastically couples the latching body 221 latching the storage part 20 to perform the self-closing operation with the closing body 211 comprises the primary elastic member 225*a* and the secondary elastic member 225*b* which have different elastic forces and are coupled in series. When the storage part 20 opens, the elastic means 225 may be stretched. In this case, a force for pulling the storage part 20 out varies according to a change in the elastic force, so that the position of the storage part 20 can be discerned where it is within the operating range of the self-closing means 200, and the position of releasing the storage part 20 from the self-closing means 200 can be also discerned. Thereby, an undesirable self-closing operation while the storage part 20 is being opened, is prevented by the smooth operation whereby it is possible for a user to notice the position of the storage part. Further, if the storage part 20 is moving in the closing direction, the drive part 117 is latched by the latching body 221 and is automatically closed by the restoring force of the elastic means 225. At this time, the closing operation is performed by the resultant force of the elastic forces of the primary and secondary elastic members 225*a* and 225*b* of the elastic means 225, thus allowing the storage part 20 to be smoothly opened and automatically closed by the increased elastic force.

Herein, the elastic means 225 comprises the primary and secondary elastic members 225*a* and 225*b* which have different elastic forces and are coupled in series, but it is only one example provided for the sake of description. That is, the elastic means 225 includes all elastic means having two or more elastic members which have different elastic forces and are coupled in series, and may comprise three, four or more elastic means 225 which have different elastic forces and are coupled in series.

The connector 226 is provided between the primary and secondary elastic members 225*a* and 225*b*, and has connecting recesses 126*a* on one end secured to the primary elastic member 225*a* and the other end secured to the secondary elastic member 225*b*. The connector 226 is placed between the primary and secondary elastic members 225*a* and 225*b* so that they are coupled in series, and the primary and secondary elastic members 225*a* and 225*b* are inserted into the corresponding connecting recesses 126*a* to make a series coupling. The connector 226 connects the primary and secondary elastic members 225*a* and 225*b* to each other in series. Thus, the primary or secondary elastic member 225*a* or 225*b* having a smaller elastic force is stretched first. When the elastic member having the smaller elastic force has been stretched and then reaches a position in the closing body 211 where the elastic member cannot move any more, the primary elastic member 225*a* stops stretching, and the secondary elastic member 225*b* starts stretching, so that a user can discern a sudden difference in tensile force. Thus, since the primary elastic member 225*a* and the secondary elastic member 225*b* are coupled to each other via the connector 226, it is easy to couple the elastic members 225*a* and 225*b* in series, a firm coupling is realized during the operation, and a user can definitely discern a difference in tensile force when the elastic members 225*a* and 225*b* having different elastic forces are stretched.

Herein, one connector 226 is provided between the primary and secondary elastic members 225*a* and 225*b* to be coupled with the two elastic members 225*a* and 225*b* in series. This is only one example provided for the sake of description. That is, connectors may be placed at respective positions for making a series coupling between a plurality of elastic members. Hence, if the elastic members are three, two connectors 226 may be provided at positions between the elastic members. Further, if the elastic members are four, three connectors 226 may be used. In other words, it is obvious to those skilled in the art that the number of couplers 226 varies according to the number of the elastic means 225 coupled in series.

The operation of the sliding apparatus with the self-closing means according to the fourth embodiment of the present invention will be described below with reference to FIGS. 15 to 18.

Figure 15:
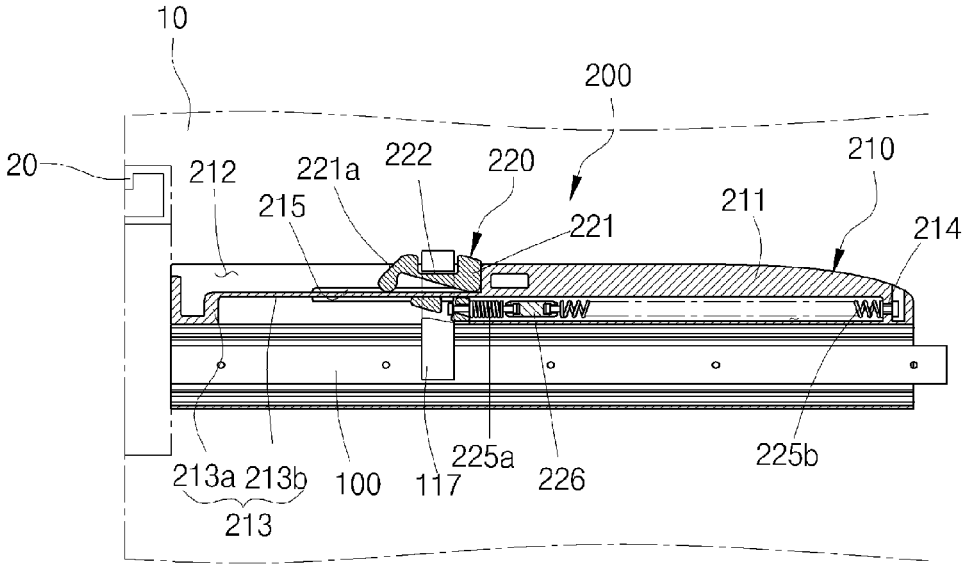
FIG. 15 is a partially cutaway view showing the operational state in which a storage part having the sliding apparatus with the self-closing means of FIG. 14 is closed.
Figure 16:
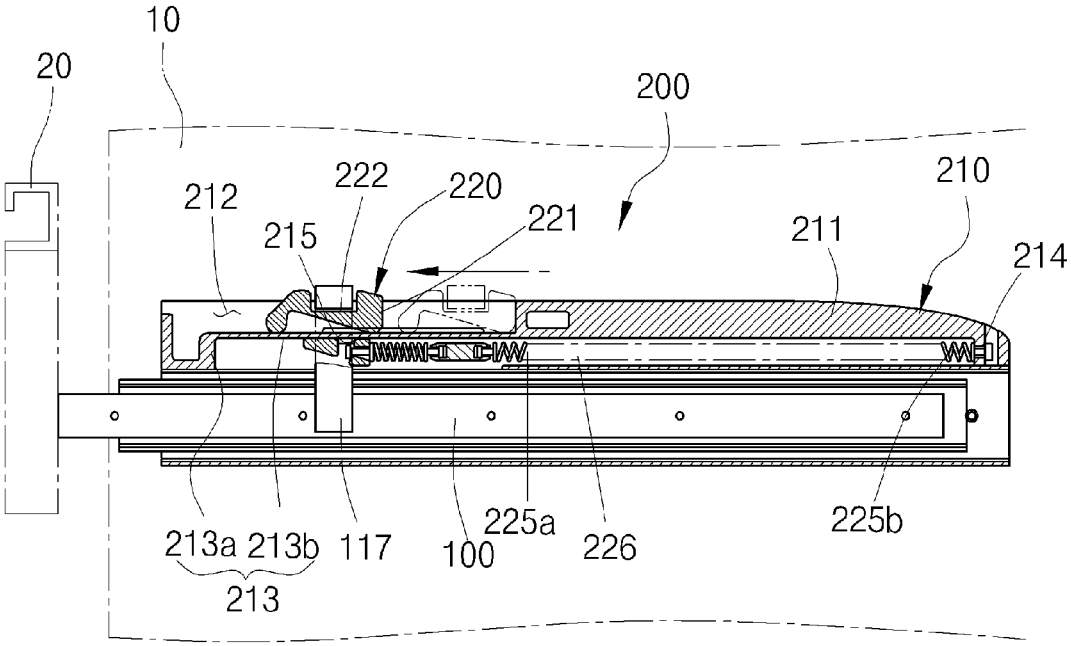
FIG. 16 is a partially cutaway view showing the operational state in which the storage part having the sliding apparatus with the self-closing means of FIG. 14 is being opened.
Figure 17:
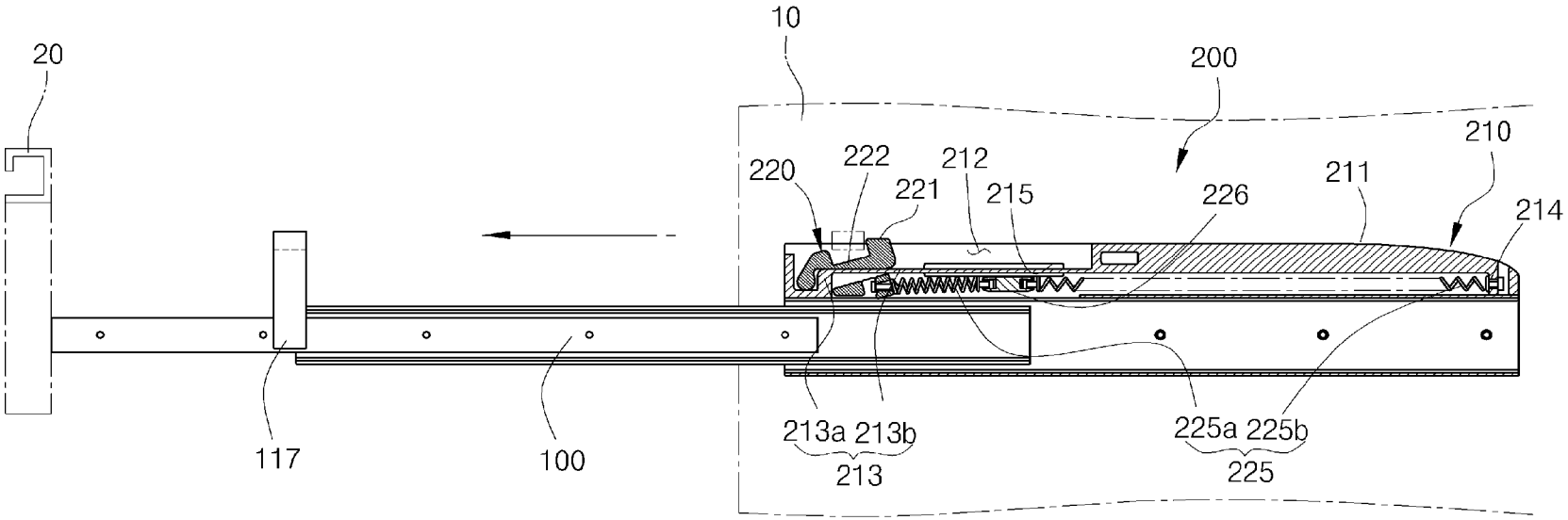
FIG. 17 is a partially cutaway view showing the operational state in which the storage part having the sliding apparatus with the self-closing means of FIG. 14 has been opened.
Figure 18:
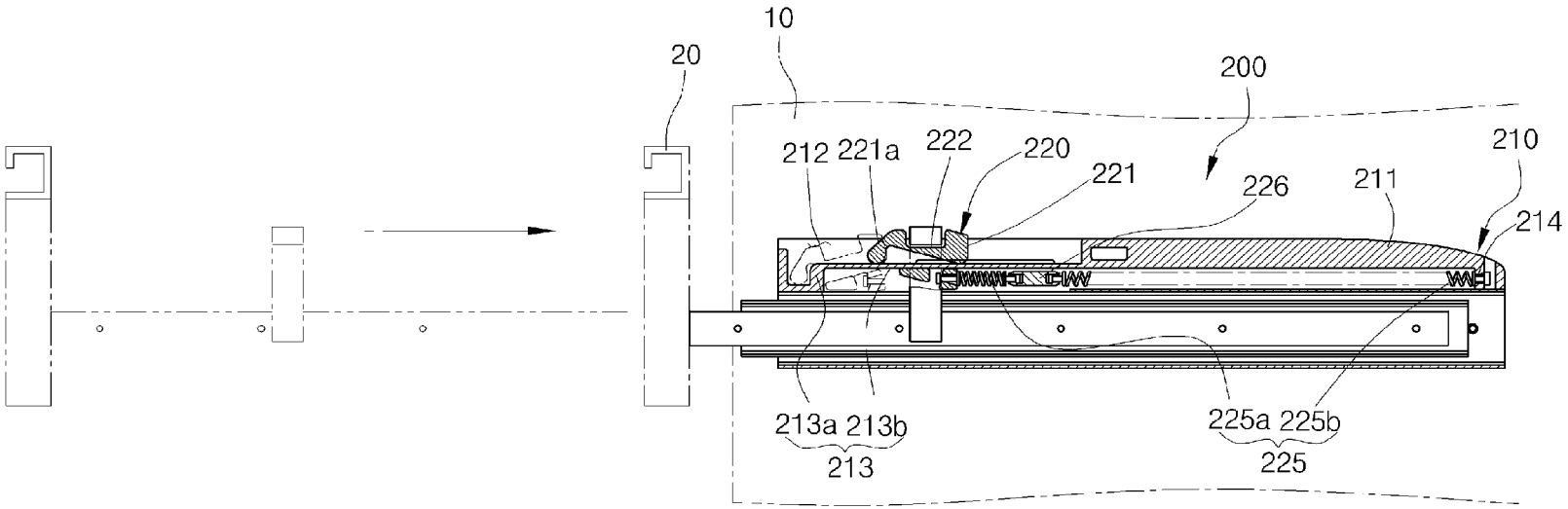
FIG. 18 is a partially cutaway view showing the operational state in which the storage part having the sliding apparatus with the self-closing means of FIG. 14 is automatically closed.

FIG. 15 is a partially cutaway view showing the operational state in which a storage part having the sliding apparatus with the self-closing means of FIG. 14 is closed, FIG. 16 is a partially cutaway view showing the operational state in which the storage part having the sliding apparatus with the self-closing means of FIG. 14 is being opened, FIG. 17 is a partially cutaway view showing the operational state in which the storage part having the sliding apparatus with the self-closing means of FIG. 14 has been opened, and FIG. 18 is a partially cutaway view showing the operational state in which the storage part having the sliding apparatus with the self-closing means of FIG. 14 is automatically closed.

Referring to FIG. 15, if the storage part 20 is in the closed position, the drive part 117 is latched by the interior of the latching depression 222, and the latching body 221 positioned in the body space 212 of the closing body 211 is located in the rear portion of the linear guide part 213*a* of the guide wall 213 placed in the closing direction.

Referring to FIG. 16, when the storage part 20 moves from the closed position in the opening direction, the drive part 117 moves along with the storage part 20 in the opening direction, and the latching body 221 latching the drive part 117 moves.

As the latching body 221 moves in the opening direction of the storage part 20, it moves along the linear guide part 213*a* inserted into the guide recess 224 to the curved guide part 213*b* while the elastic means 225 is stretched.

The elastic means 225 comprises the primary and secondary elastic members 225*a* and 225*b* which have different elastic forces and are coupled to each other via the connector 226, and is placed between the latching body 221 and the closing body 211. Thus, when the elastic means 225 is stretched, both the primary and secondary elastic members 225*a* and 225*b* which are coupled in series are simultaneously stretched. If both the primary and secondary elastic members 225*a* and 225*b* are simultaneously stretched, either of the primary or secondary elastic member 225*a* or 225*b* having a smaller elastic force is first stretched, and the connector 226 moves together. When the connector 226 reaches a position in the closing body 211 where it cannot move any more, an elastic member having a larger elastic force is stretched, so that a user can discern a change in sudden tensile force. That is, since the user can discern a position where a tensile force changes during the opening operation, he or she can operate the sliding apparatus while being aware of the degree to which the storage part 20 has opened.

Referring to FIG. 17, when the storage part 20 is continuously moved in the opening direction, the latching body 221 is rotatably moved along the curved guide part 213*b* which is bent downwards, and the front portion of the rotated latching body 221 which is located in the opening direction of the storage part 20 moves downwards. If the front portion of the latching body 221 moves downwards, a portion of the latching depression 222 located in the opening direction opens, so that the drive part 117 is released from the latching body 221. The drive part 117 released from the latching body 221 can be continuously moved in the opening direction along with the storage part 20. The latching body 221 rotatably inserted into the curved guide part 213*b* may be positioned in a portion of the closing body 211 located in the opening direction of the storage part 20, with the elastic means 225 stretched.

Here, in the opening operation, while the primary and secondary elastic members 225*a* and 225*b* of the elastic means 225 are coupled in series, a change in elasticity from the elastic member having a smaller elastic force to the elastic member having a larger elastic force is discerned, the latching body is inserted into the curved guide part 213*b*, and the elastic means 225 maintains a stretched state. A user can discern the elastic member having the larger elastic force and a position where the elastic force does not act during the opening operation. That is, the user can discern that the storage part 20 which is being opened moves out of the self-closing section of the self-closing means 200, thus preventing him or her from being surprised or preventing his or her finger from being caught by the sliding apparatus because of an undesirable self-closing operation.

Referring to FIG. 18, if the storage part 20 moves to the closed position again, the drive part 117 is latched by the latching depression 222 of the latching body 221 positioned in the closing body 211 to move the latching body 221 in the closing direction. If the latching body 221 moves in the closing direction of the storage part 20, the latching body 221 is guided and moved from the curved guide part 213*b* to the linear guide part 213*a*. At this time, if the latching body 221 moves from the curved guide part 213*b* to the linear guide part 213*a*, the storage part 20 is automatically closed in the closing direction of by the elastic force of the elastic means 225. If the latching body 221 moves, the drive part 117 latched by the latching body 221 moves along with the storage part 20, so that the storage part 20 closes automatically.

Here, the elastic means 225 comprises the primary and secondary elastic members 225*a* and 225*b* which have different elastic forces and are coupled in series via the connector 226, and performs the self-closing operation by the resultant force of the elastic forces of the primary and secondary elastic members 225*a* and 225*b*, so that the elastic force increases and thus closing efficiency can be improved. That is, when the primary and secondary elastic members 225*a* and 225*b* each of different elastic forces are coupled in series via the connector 226 and are restored from the stretched state to the original state, they are restored to the original state by the resultant force of the two elastic members 225*a* and 225*b*, so that the elastic force increases and thus a reliable closing force can be generated.

If an external force acts on the latching body 221 positioned in the curved guide part 213*b*, or an opening operation is performed when the latching body 221 does not move completely to the curved guide part 213*b*, the self-closing means 200 with the multiple elastic members is moved in the closing direction by the elastic force of the elastic means 225 having the primary and secondary elastic members 225*a* and 225*b* with the different elastic forces coupled in series, thus causing a malfunction that prevents the self-closing operation.

Figure 19:
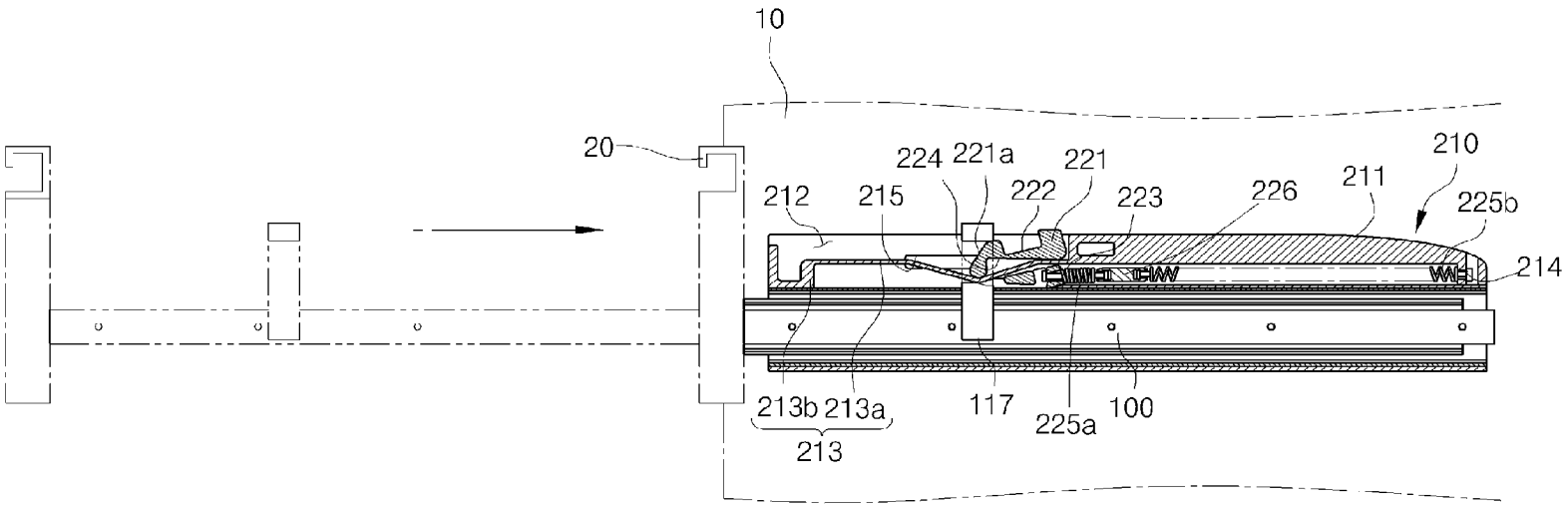
FIG. 19 is a partially cutaway view showing the operational state in which the sliding apparatus with the self-closing means of FIG. 14 is restored from a malfunction state to the original state thereof.

In order to solve the aforementioned malfunction, as shown in FIG. 19, the storage part 20 is forcibly closed to be restored to its original state.

If the storage part 20 is forcibly closed in the state in which the latching body 221 is positioned in the rear portion of the linear guide part 213*a* of the guide wall 213 by the malfunction, the drive part 117 provided on each of the opposite sides of the storage part 20 moves to the latching body 221. When the drive part 117 reaches the latching body 221, the drive part 117 makes contact with the front portion of the latching body 221 located in the opening direction and is inserted into the latching depression 222. Here, the linear guide part 213*a* of the guide wall 213 into which the latching body 221 is inserted may be elastically deformed at the position of the through hole 215. That is, since the linear guide part 213*a* is released at the position of the through hole 215, the linear guide part 213*a* may be elastically deformed by pressing. If the drive part 117 comes into contact with the latching body 221, a pushing force is generated to push the front portion of the latching body 221 provided in the opening direction downwards, and the linear guide part 213*a* of the guide wall 213 is elastically deformed and moved downwards at the position of the through hole 215, so that the drive part 117 is latched by the latching depression 222. The inclined surface 221*a* is provided at the position where the latching body 221 contacts the drive part 117 in such a way that the sectional area of the inclined surface 221*a* is enlarged towards the latching depression 222, thus minimizing interference between the drive part 117 and the latching body 221. Thereby, the drive part 117 is inserted into the latching depression 222 while the elastic deformation of the linear guide part 213*a* is minimized, so that the drive part 117 is latched by the latching body 221. If the storage part 20 moves in the opening direction with the drive part 117 being latched by the latching depression 222 formed in the upper portion of the latching body 221, the latching body 221 is inserted into the curved guide part 213*b* again, so that the elastic means 225 is restored to the stretched state, namely, the normal operation state permitting the self-closing operation, and thus the self-closing means 200 may be repetitively operated.

Further, a sliding apparatus with a self-closing means according to the fifth embodiment of the present invention will be described below with reference to FIG. 20.

Figure 20:
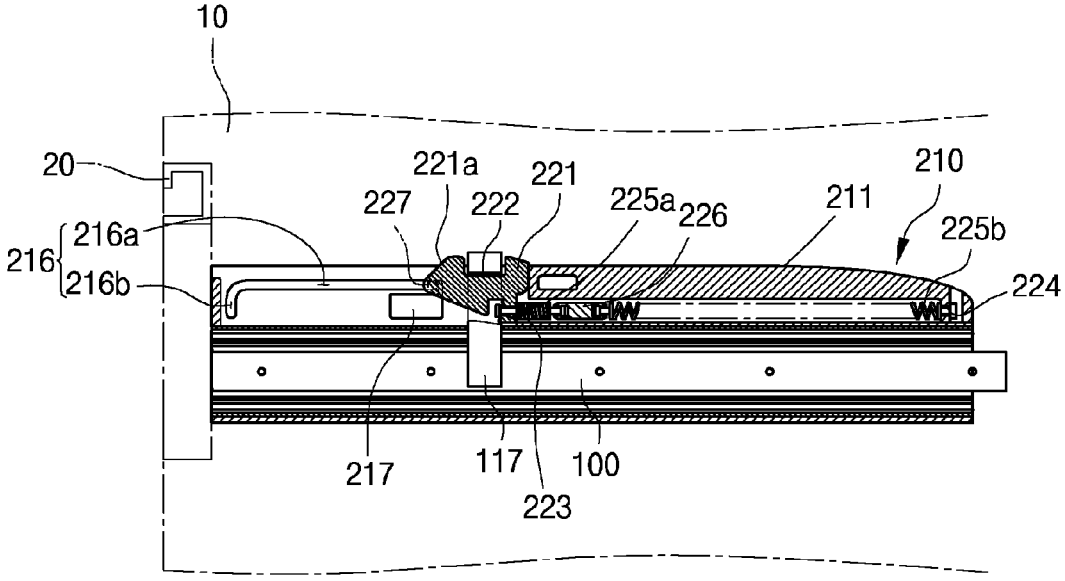
FIG. 20 is a partially cutaway view showing a sliding apparatus with a self-closing means, according to a fifth embodiment of the present invention.

FIG. 20 is a partially cutaway view showing a sliding apparatus with a self-closing means, according to a fifth embodiment of the present invention.

Since the sliding apparatus 100 with the self-closing means according to the fifth embodiment of the present invention shown in FIG. 20 is identical with the sliding apparatus 100 with the self-closing means shown in FIGS. 1 to 5 except for the self-closing means 130, this same construction will not be shown nor described in detail. The self-closing means 200 includes a body unit 210 which is provided on each of opposite sides, and a latching unit 220. Here, since some components of the body unit 210 and the latching unit 220 substantially remain the same as those of the self-closing means 200 shown in FIG. 14, a detailed description will be omitted.

An elongate guide hole 216 is formed at a surface in the body space 212 of the body unit 210 so that the latching unit 220 is inserted into and guided along the guide hole 216. The guide hole 216 has a linear guide part 216*a* and a curved guide part 216*b*. The linear guide part 216*a* is formed in the body space 212 in such a way as to extend from a position in the closing direction of the storage part 20 to the opening direction thereof in the shape of a straight line. The curved guide part 216*b* is connected to a portion of the linear guide part 216*a* located in the opening direction of the storage part 20, and is bent downwards. The latching unit 220 is guided from the closed position of the storage part 20 to the linear guide part 216*a*, and moves along the linear guide part 216*a* to the curved guide part 216*b* when moved in the opening direction from the closed position. The latching unit 220 is inserted into the curved guide part 216*b* to be secured thereto. If the storage part 20 moves to the closed position again, the drive part 117 moves from the curved guide part 216*b* to the linear guide part 216*a* while being latched by the latching unit 220, so that the drive part 117 can be moved to the closed position.

Further, a guide elastic deformation hole 217 is formed around a portion of the linear guide part 216*a* located in the closing direction of the storage part 20 in such a way as to partially communicate with the linear guide part 216*a*. The guide elastic deformation hole 217 partially communicates with the linear guide part 216*a* to elastically deform it, thus enabling the drive part 117 to be latched again by the latching unit 220 placed on the rear portion of the linear guide part 216*a* in the event of a malfunction.

A guide protrusion 227 is provided on a surface of the latching body 221 of the latching unit 220 and is inserted into the guide hole 216. The guide protrusion 227 is inserted into the guide hole 216, thus allowing the latching body 221 to move along the curved guide part 216*b* and the linear guide part 216*a*. The latching body 221 elastically biased by an elastic means 225 moves along the guide hole 216 into which the guide protrusion 227 is inserted, thus automatically closing the storage part 20. Here, the elastic means 225 comprises primary and secondary elastic members 225*a* and 225*b* having the different elastic forces and coupled in series via a connector 226. If the primary and secondary elastic members 225*a* and 225*b* which have different elastic forces are coupled in series and stretched by opening the storage part 20, the elastic members 225*a* and 225*b* are stretched in order of the difference in their elastic forces, thus allowing a user to discern a position where the storage part 20 is released from the latching body 221, therefore preventing the user from being injured by the undesirable self-closing of the storage part 20. Further, the storage part 20 is closed by the resultant force of the primary and secondary elastic members 225*a* and 225*b* having different elastic forces, so that closing efficiency can be increased.

Further, a sliding apparatus with a self-closing means according to the sixth embodiment of the present invention will be described below with reference to FIG. 21.

Figure 21:
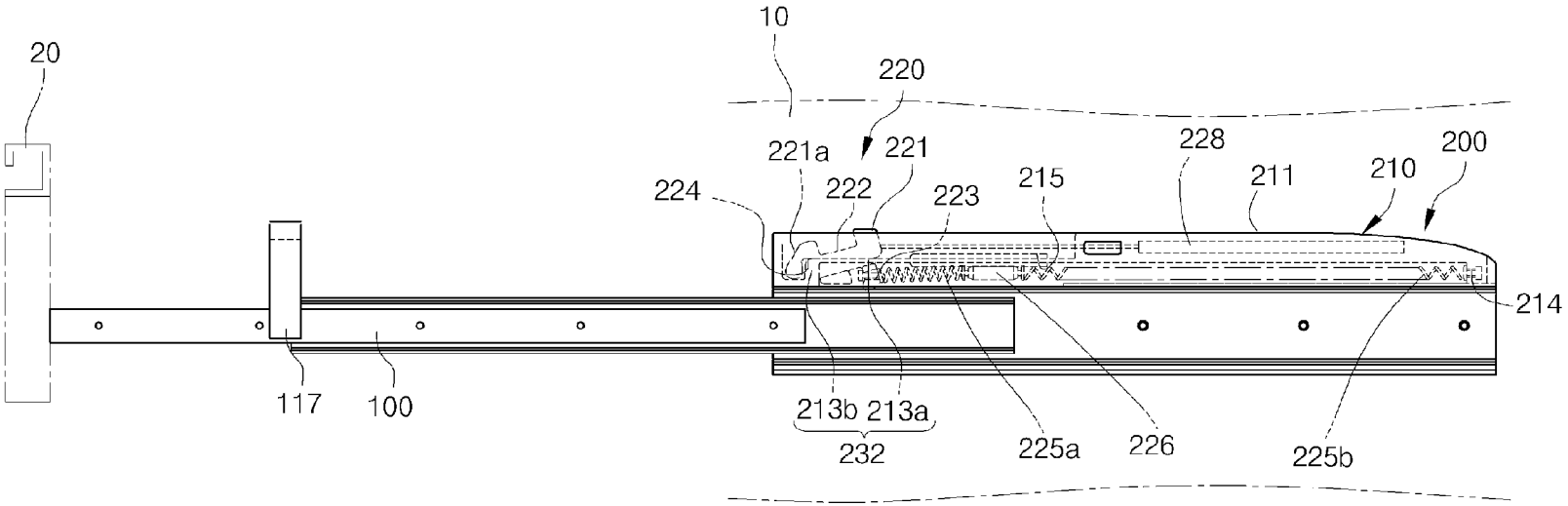
FIG. 21 is a view showing a sliding apparatus with a self-closing means, according to a sixth embodiment of the present invention.

FIG. 21 is a view showing a sliding apparatus with a self-closing means, according to a sixth embodiment of the present invention.

Since the sliding apparatus 100 with the self-closing means according to the sixth embodiment of the present invention shown in FIG. 20 is identical with the sliding apparatus 100 with the self-closing means shown in FIGS. 1 to 5 except for the self-closing means 130, this same construction will not be shown nor described in detail. The self-closing means 200 includes a body unit 210 which is provided on each of opposite sides, and a latching unit 220. Here, since some components of the body unit 210 and the latching unit 220 substantially remain the same as those of the self-closing means 200 shown in FIG. 14 or 20, a detailed description will be omitted. That is, the self-closing means 200 of FIG. 21 is another embodiment of the latching unit 220. It is obvious to those skilled in the art that this may be applied to the fourth embodiment of FIG. 14 and the fifth embodiment of FIG. 20.

The latching unit 220 may further include a closing damper 228 which is provided in the closing body 211 and makes contact with a portion of the latching body 221 placed in the closing direction of the storage part 20. The closing damper 228 is operated to perform a smooth closing operation while absorbing some of the elastic force in the closing direction of the latching body 221 which is automatically closed by the elastic force of the elastic means 225 which comprises the primary and secondary elastic members 225*a* and 225*b* which have different elastic forces and are coupled in series. Further, when the latching body 221 moves in the opening direction of the storage part 20, the closing damper 228 is operated to support the latching body 221 and move it in the opening direction, thus allowing the storage part 20 to be smoothly opened.

Herein, the closing damper 228 is a general damper which is capable of lessening shock using a fluid such as oil, and a detailed description thereof will be omitted.

Moreover, a sliding apparatus with a middle stop toothed part according to the seventh embodiment of the present invention will be described below with reference to FIGS. 22 to 24.

Figure 22:
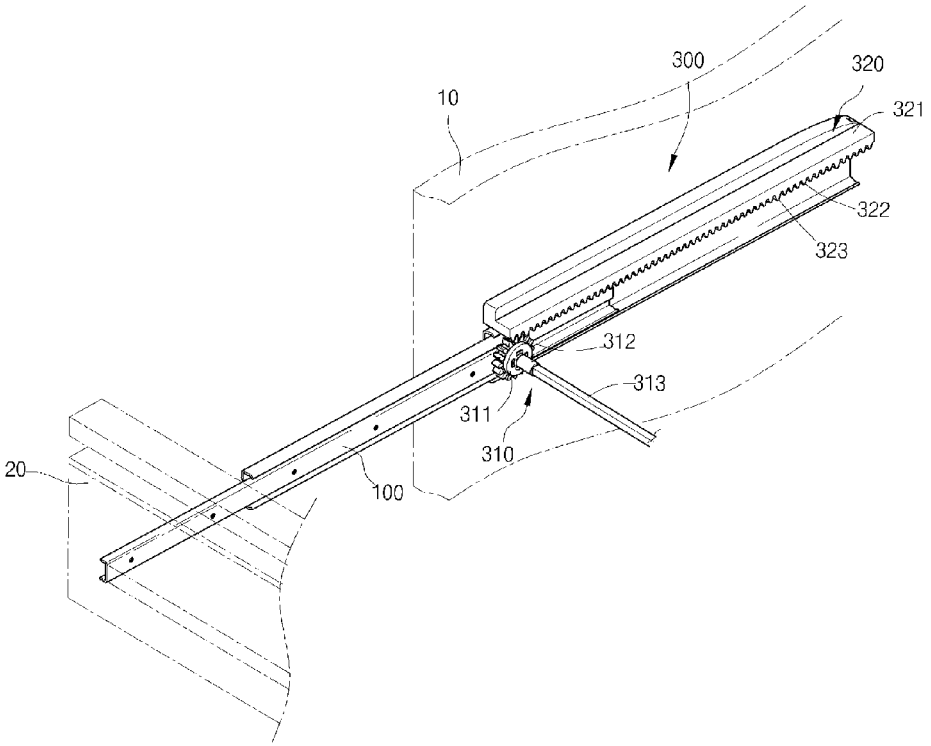
FIG. 22 is a view showing a sliding apparatus with a self-closing means, according to a seventh embodiment of the present invention.
Figure 23:
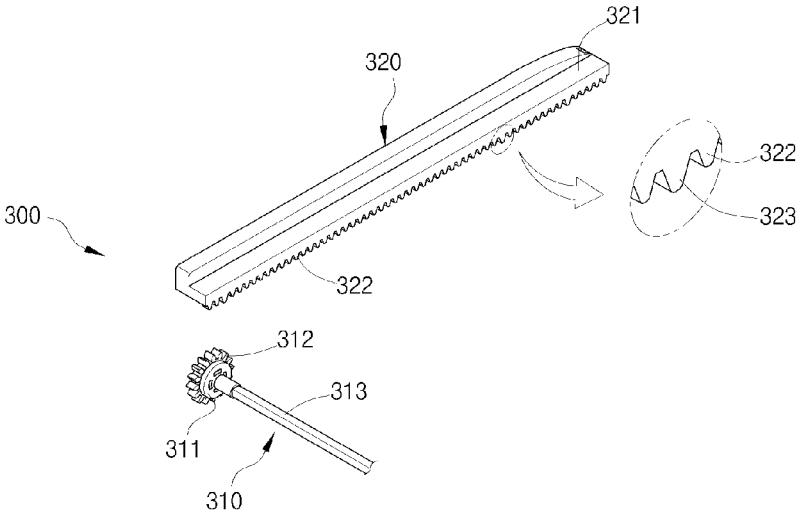
FIG. 23 is an exploded perspective view showing a rotary gear unit and a fixed gear unit provided on the sliding apparatus with the self-closing means of FIG. 22.
Figure 24:
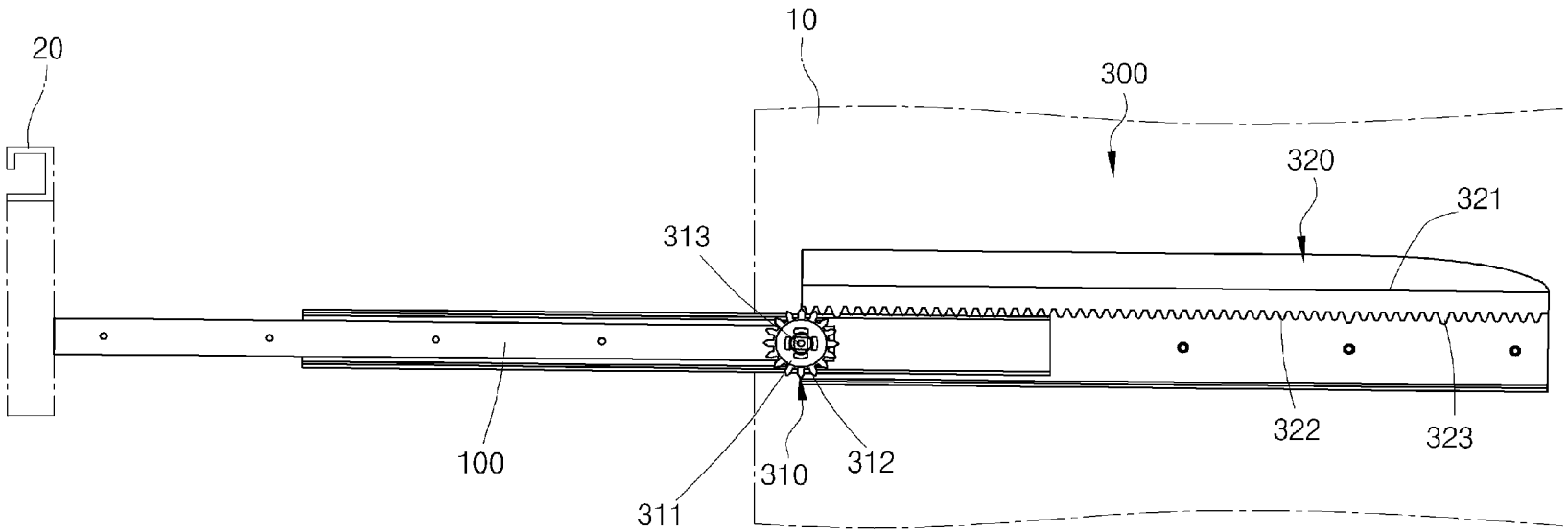
FIG. 24 is a side view showing the state in which the sliding apparatus with the self-closing means of FIG. 22 is mounted.

FIG. 22 is a view showing a sliding apparatus with a self-closing means, according to a seventh embodiment of the present invention, FIG. 23 is an exploded perspective view showing a rotary gear unit and a fixed gear unit provided on the sliding apparatus with the self-closing means of FIG. 22, and FIG. 24 is a side view showing the state in which the sliding apparatus with the self-closing means of FIG. 22 is mounted.

The sliding apparatus 100 with the self-closing means according to the seventh embodiment of the present invention shown in FIGS. 22 to 24 has a gear assembly 300 that is another embodiment of the pinion gear unit 21, the coupling bar 22, and the rack gear unit 140 which are included in the sliding apparatus 100 with the self-closing means shown in FIGS. 11 and 12. Since the remaining construction of the sliding apparatus 100 according to the seventh embodiment is equal to that of the sliding apparatus 100 shown in FIGS. 11 and 12, this same construction will not be shown nor described herein.

The gear assembly 300 includes a rotary gear unit 310 which moves along with the storage part 20, and a fixed gear unit 320. The rotary gear unit 310 includes rotary bodies 311 which are provided on the opposite sides of the storage part 20, a rotary toothed part 312, and a coupling bar 313. The rotary body 311 is provided on each of the opposite sides of the storage part 20 in the closing direction thereof, and comprises the shape of a rotatable wheel. The rotary body 311 is formed in the shape of the wheel and rotatably engages with an associated gear unit.

The rotary toothed part 312 protrudes outwards from the outer circumference of the rotary body 311, and comprises a plurality of teeth. The rotary toothed part 312 protrudes to allow the rotary body 311 provided on each side of the storage part 20 to engage with the fixed gear unit. That is, the rotary toothed part 312 is provided on the outer circumference of the rotary body 311 to engage with the fixed gear unit 320.

The coupling bar 313 is placed on a side of the storage part 20 in the closing direction thereof, and is supported to be rotatably moved along with the storage part 20. The coupling bar 313 couples the rotary bodies 311 provided on the opposite sides of the storage part 20 to each other, and is rotatably supported by the storage part 20 so that the rotary body 311 engaging with the fixed gear unit 320 via the rotary toothed part 312 is rotated and moved along with the storage part 20 when it is moved. If the storage part 20 moves, the coupling bar 313 moves along with the storage part 20. The rotary bodies 311 coupled to the opposite sides of the coupling bar 313 while each is engaged with the fixed gear unit 320 are also rotatably moved. As each rotary body 311 engaged with the fixed gear unit 320 rotates, the rotary bodies 311 provided on the opposite sides move at the same speed according to the interval between the teeth of the rotary toothed part 312, so that both sides of the storage part 20 move at the same speed, and thus the twisting of the storage part 20 caused by a difference in moving speed between the two sides can be prevented. Further, the storage part 20 is slidably coupled to the main body 10 using the sliding apparatus 100 which is installed so that a rear portion placed in the closing direction is lower than a front portion placed in the opening direction. Thus, as the storage part 20 moves to the closed position because of gravity, each rotary body 311 having the rotary toothed part 312 engaged with the fixed gear unit 320 is rotatably moved, so that both sides can be moved at the same speed in the closing direction.

The fixed gear unit 320 includes fixed bodies 321 which are placed on the opposite sides of the main body 10, a fixed toothed part 322, and a stop toothed part 323. The fixed bodies 321 are placed on the opposite sides of the main body 10, and are located to be in contact with the upper portions of the corresponding rotary bodies 311. Each fixed body 321 is secured to the main body 10, and is inclined to be in contact with the upper portion of the corresponding rotary body 311 according to the moving angle of the rotary body 311 which moves along with the storage part 20 that obliquely moves according to the inclination of the sliding apparatus 100. That is, since the storage part 20 is slidably coupled to the sliding apparatus 100 which is arranged such that a portion placed in the closing direction is lower than a portion placed in the opening direction, the rotary body 311 also moves along with the storage part 20 while maintaining the same angle as the sliding apparatus 100. Therefore, the fixed body 321 which is in contact with the upper portion of the rotary body 311 may also be installed at the same angle as the moving angle of the rotary body 311.

The fixed toothed part 322 is provided on the lower portion of the fixed body 321 in such a way as to engage with the rotary toothed part 312. The fixed toothed part 322 engages with the rotary toothed part 312, so that the rotary body 311 may rotatably move when the storage part 20 moves. The fixed body 321 from which the fixed toothed part 322 protrudes is formed in the opening or closing section of the storage part 20 and has a size that allows the rotary body 311 to rotate to move. Since the fixed toothed part 322 is provided on the lower portion of the fixed body 321 which is inclined according to the moving angle of the storage part 20, the fixed toothed part 322 may stay engaged with the rotary toothed part 312 which is provided on the outer circumference of the rotary body 311 moving along with the storage part 20 which is slid by the inclined sliding apparatus 100. That is, in order to keep the storage part 20 closed when external force does not act on the storage part 20, the sliding apparatus 100 is slidably coupled between the main body 10 and the storage part 20 such that the rear portion placed in the closing direction thereof is located at a lower position, and the storage part 20 is inclined to be moved in the closing direction because of gravity according to the installing angle of the sliding apparatus 100. Thus, the rotary bodies 311 provided on opposite sides are obliquely moved according to the moving angle of the storage part 20, and the fixed toothed part 322 engaging with the rotary toothed part 312 provided on the outer circumference of each rotary body 311 must be formed at an inclined position, so that the fixed body 321 is secured to the main body 10 while being inclined according to the moving angle of the storage part 20. Thus, while the fixed toothed part 322 provided on the lower portion of the fixed body 321 obliquely secured to the main body 10 engages with the rotary toothed part 312, each rotary body 311 may rotate to move along with the storage part 20.

The stop toothed part 323 comprises at least one tooth which is larger than the teeth of the fixed toothed part 322, and is of such a size that it may be moved by the force of a user in the state in which the stop toothed part 323 engages with the rotary toothed part 312 by the rotation of the rotary body 311. The size of the stop toothed part 323 is set such that the rotary body 311 is stopped by the stop toothed part 323 at a desired position and passes the stop toothed part 323 when a user applies an operating force to the storage part 20. At least one stop toothed part 323 may be formed at desired positions of the fixed toothed part 322. When the rotary toothed part 312 engaging with the fixed toothed part 322 rotates and reaches the stop toothed part 323, the rotary toothed part 312 is stopped by the stop toothed part 323 and thus stops rotating. When the rotary toothed part 312 stops rotating, the storage part 20 moving along with the rotary toothed part 312 stays in the stopped state. If a user applies an operating force to the storage part 20 which has stopped, the rotary toothed part 312 may continue to move while passing the stop toothed part 323. That is, unless external force acts on the storage part 20 which is slidably coupled to the sliding apparatus 100 inclined in the closing direction, the storage part 20 is moved by gravity in the closing direction. As the storage part 20 moves, the rotary body 311 is rotated and the rotary toothed part 312 moved along the fixed toothed part 322. The rotary toothed part 312 which is being moved is stopped by the stop toothed part 323 provided at a desired position, so that the storage part 20 maintains the stop state. Next, in the state in which the storage part 20 has stopped, if a user applies an operating force to the storage part 20, the rotary toothed part 312 passes the stop toothed part 323 and moves towards the fixed toothed part 322 again, thus allowing the storage part 20 to move again.

Moreover, the operation of the sliding apparatus with the self-closing means according to the seventh embodiment of the present invention is as follows.

Figure 25:
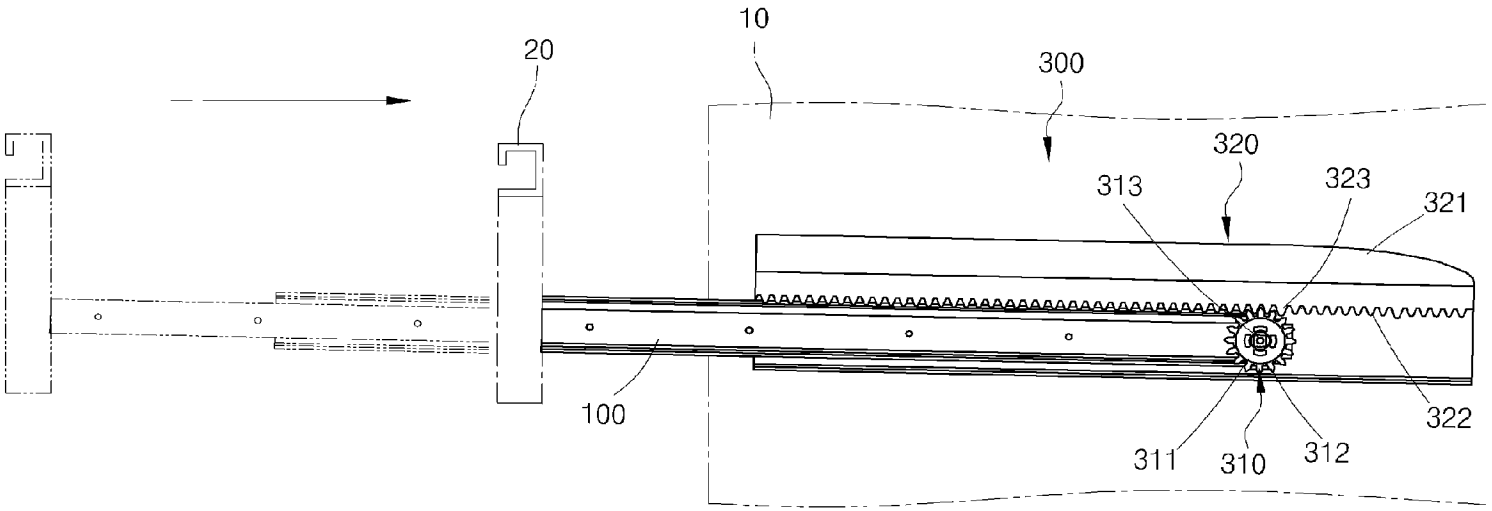
FIG. 25 is a side view showing the state in which the sliding apparatus with the self-closing means of FIG. 22 is stopped at a certain point.

FIG. 25 is a side view showing the state in which the sliding apparatus with the self-closing means of FIG. 22 is stopped at a certain point.

Referring to FIG. 25, the sliding apparatus 100 slidably coupling the main body 10 with the storage part 20 is installed such that a portion placed in the closing direction is lower than a portion placed in the opening direction. Thus, unless the open storage part 20 is supported, the storage part 20 moves in the closing direction. At this time, the rotary bodies 311 which are provided on the opposite sides and coupled via the coupling bar 313 rotatably supported on the rear portion of the storage part 20 and which each have on the outer circumference the rotary toothed part 312 engaged with the fixed toothed part 322 are rotated, so that both sides of the storage part 20 move at the same speed. Here, the storage part 20 which is slid by the sliding apparatus 100, which is at an angle, is obliquely moved by gravity to the portion placed in the closing direction, which is lower than the portion placed in the opening direction. According to the moving angle of the storage part 20, the fixed body 321 having on its lower portion the fixed toothed part 322 is installed to maintain an inclination angle corresponding to the moving angle, thus allowing the rotary toothed part 312 to rotatably move while engaging with the fixed toothed part 322.

If the storage part 20 moves in the closing direction by gravity, the rotary body 311 is rotated and the rotary toothed part 312 is rotatably moved on the fixed toothed part 322 while engaging therewith. When the rotary toothed part 312 reaches the stop toothed part 323 comprising a tooth which is larger than the teeth of the fixed toothed part 322 and is provided at a desired position, the rotary toothed part 312 is stopped and the rotary body 311 is in the stopped state. If the rotary body 311 stops, the storage part 20 is not moved in the closing direction by gravity.

If a user applies an operating force to the storage part 20 which has stopped at a desired position, the rotary toothed part 312 passes the stop toothed part 323, so that the storage part 20 may be moved again. That is, unless the external force acts on the storage part 20, the storage part 20 moves in the closing direction and simultaneously the rotary body 311 is rotatably moved along with the storage part 20. The rotary body 311 is stopped by the stop toothed part 323 provided at a desired position. If the operating force acts on the storage part 20, the storage part 20 may move again. Therefore, this embodiment provides the gear unit 100 which allows a user to stop the storage part 20 at a desired time.

For example, while the storage part 20 installed in a refrigerator is opened at a minimum angle that allows foodstuffs to be put into or taken out of the storage part 20 so as to prevent the loss of cool air, the foodstuffs may be put in or taken out. Here, since the storage part 20 is slidably coupled to the main body 10 via the inclined sliding apparatus 100, the storage part 20 moves in the closing direction under gravity unless an external force acts thereon. If the storage part 20 moves in the closing direction, the rotary body 311 having on its outer circumference the rotary toothed part 312 which engages with the fixed toothed part moves along with the storage part 20 while rotating. When the rotary toothed part 312 rotates and reaches the stop toothed part 323 provided at the minimum open position that allows the user to put in or take out the foodstuffs, the rotary toothed part 312 is stopped by the stop toothed part 323 and thus stops rotating. If the rotary toothed part 312 stops rotating, each rotary body 311 is stopped. When the rotary bodies 311 provided on the opposite sides are stopped, the movement of the storage part 20 in the closing direction is stopped. As such, in the state in which the closing of the storage part 20 has stopped at the minimum open position, foodstuffs may be put in or taken out of the storage part 20. When the operation of putting in or taking out the foodstuffs is finished, an operating force is applied to move the storage part 20 in the closing direction, so that the rotary toothed part 312 passes the stop toothed part 323 and moves again in the closing direction. Further, even when the storage part 20 opens, the rotary toothed part 312 is stopped by the stop toothed part 323 to maintain the stop state of the storage part 20, thus allowing a user to perform the operation while the storage part 20 is kept open at the minimum open position, therefore minimizing the leakage of cool air from the refrigerator.

As described above, while the storage part 20 is stopped at a desired position by the stop toothed part 323 which is provided between the teeth of the fixed toothed part 322, a user may perform the operation. Further, the stop toothed parts 323 may be provided such that the storage part 20 is stopped at ends in the opening and closing directions, thus preventing the rotary toothed part 312 from moving out of a range of the fixed toothed part 322, therefore limiting the range of rotation of the rotary body 311 which has on its outer circumference the rotary toothed part 312.

Further, a sliding apparatus with a self-closing means according to the eighth embodiment of the present invention will be described below with reference to FIGS. 26 to 28.

Figure 26:
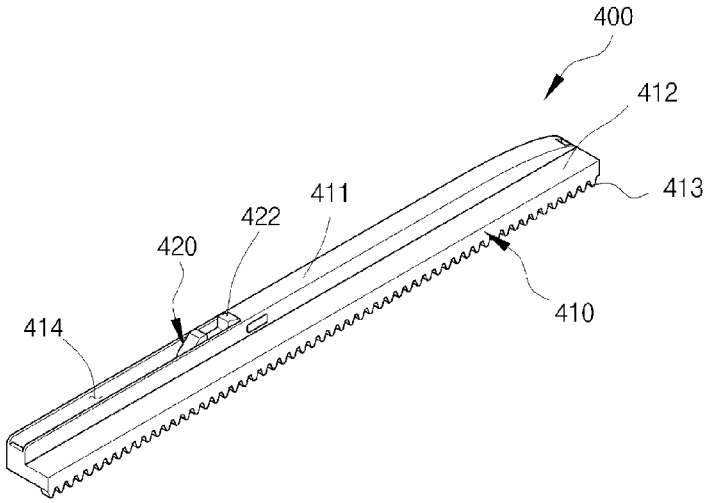
FIG. 26 is a perspective view showing a sliding apparatus with a self-closing means, according to an eighth embodiment of the present invention.
Figure 27:
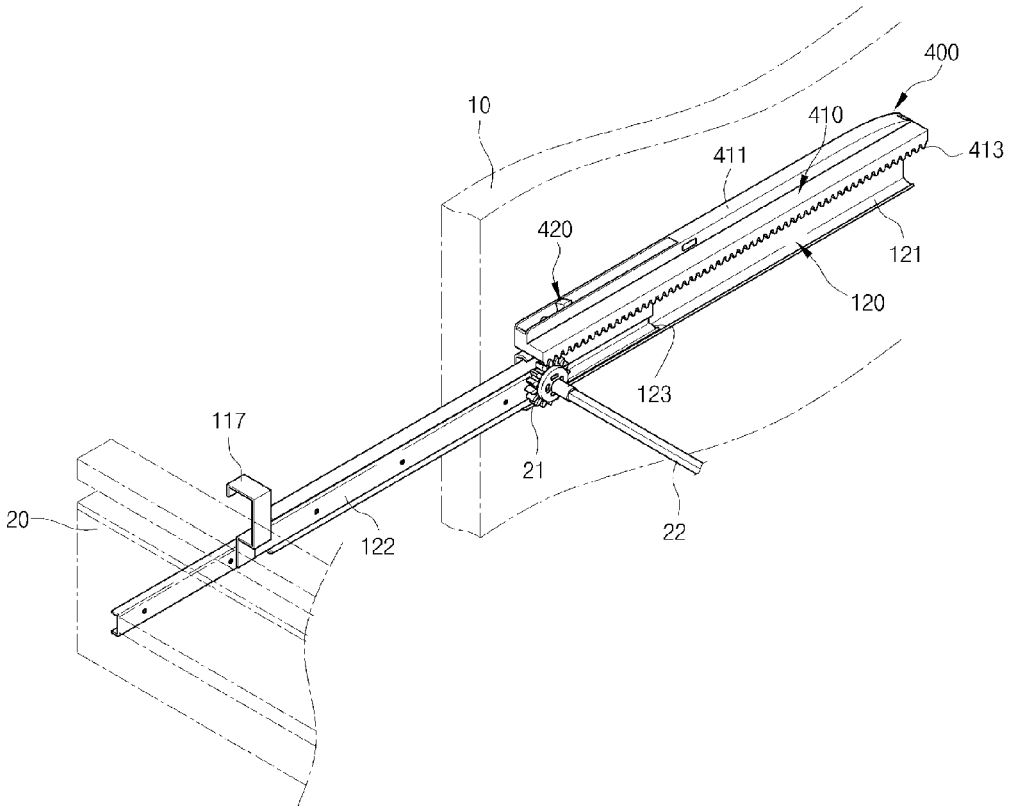
FIG. 27 is a perspective view showing the state in which the sliding apparatus with the self-closing means of FIG. 26 is mounted.
Figure 28:
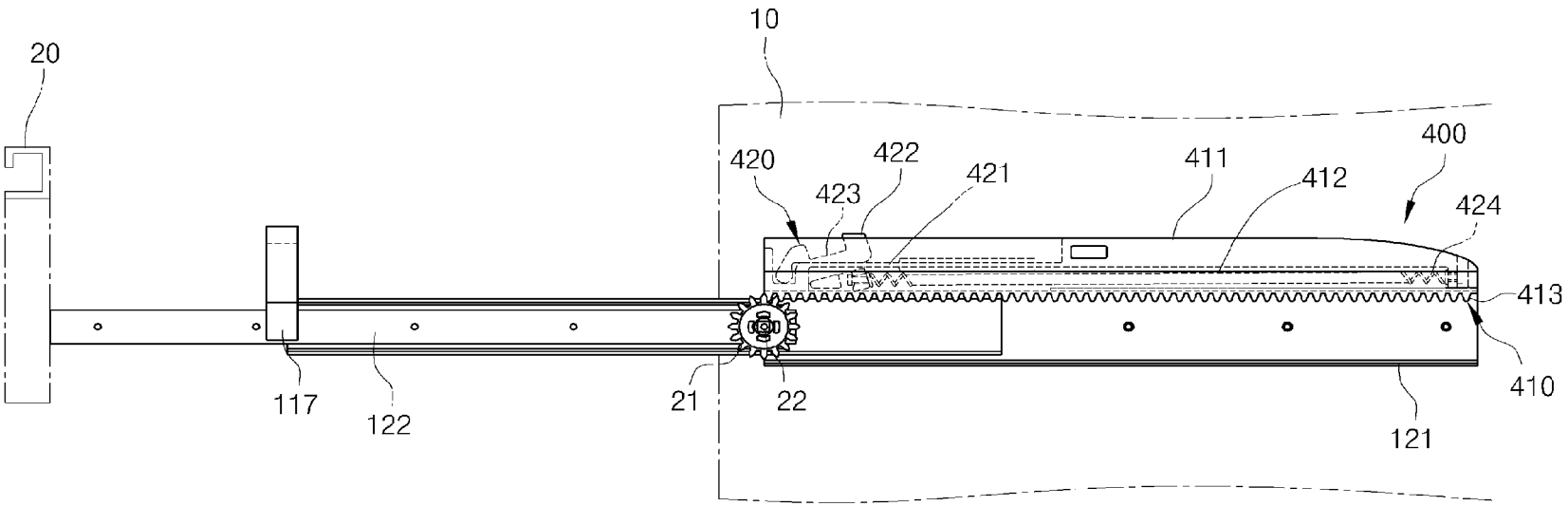
FIG. 28 is a side view showing the state in which the sliding apparatus with the self-closing means of FIG. 26 is mounted.

FIG. 26 is a perspective view showing a sliding apparatus with a self-closing means, according to an eighth embodiment of the present invention, FIG. 27 is a perspective view showing the state in which the sliding apparatus with the self-closing means of FIG. 26 is mounted, and FIG. 28 is a side view showing the state in which the sliding apparatus with the self-closing means of FIG. 26 is mounted.

Referring to FIGS. 26 to 28, the sliding apparatus 100 with the self-closing means according to the eighth embodiment of the present invention includes a rack unit 400 that is different from the rail support 110, the self-closing means 130, and the rack gear unit 140 of the sliding apparatus 100 with the self-closing means shown in FIGS. 1 to 5, and is also different from the pinion gear unit 21, the coupling bar 22, and the rack gear unit 140 of the sliding apparatus with the self-closing means shown in FIGS. 11 and 12. The remaining construction of the eighth embodiment remains the same as the above-mentioned embodiments, so this construction will not be shown nor described.

The rack unit 400 includes a rack body unit 410 which is secured at a position to engage with the storage part 20, and a self-closing unit 420. The rack body unit 410 includes a rack body 411 which is provided at a position of on the main body 10 to engage with the pinion gear unit 21 placed on each of the opposite sides of the storage part 20, and a gear protrusion 412. The rack body 411 is secured to each of the opposite sides of the main body 10, and is placed above the pinion gear unit 21 to engage therewith. The rack body 411 is placed on the upper portion of the sliding apparatus which slidably couples the storage part 20 with the main body 10 so as not to interfere with the sliding operation of the storage part 20.

The gear protrusion 412 protrudes from each of the opposite sides of rack bodies 411, and has on its lower portion a tooth-shaped rack gear 413. The gear protrusion 412 protrudes toward the storage part 20 so that the pinion gear unit 21 provided on each of the opposite sides of the storage part 20 engages with the rack gear 413 provided on the lower portion of the gear protrusion 412. The rack gear 413 engages with the pinion gear unit 21 provided on each of the opposite sides of the storage part 20, so that the pinion gear unit 21 is rotated when the storage part 20 moves, and both sides of the storage part 20 can be moved at the same speed.

The length of the rack body 411 may be set according to the operating distance of the storage part 20. That is, the gear protrusion 412 having the rack gear 413 protrudes from each of the opposite sides of rack bodies 411. The rack gear 413 engages with the pinion gear unit 21 which moves along with the storage part 20. Thus, the rack gear 413 must be formed over the entire operating distance of the pinion gear unit 21 which moves along with the storage part 20, so that the rack body 411 has a size corresponding to the entire operating distance of the storage part 20.

A body closing space 414 is formed at a predetermined position of the rack body 411 in such a way as to pass vertically through the rack body 411. The body closing space 414 is formed at a position that allows the drive part 117 moving along with the storage part 20 to be inserted upwards, with the self-closing unit 420 disposed in the body closing space 414. The body closing space 414 is formed in the rack body 411 which is located at the operating position of the storage part 20 to control a self-closed position and a self-closing distance, thus allowing the self-closing operation to be performed from a desired distance and at a desired position.

The self-closing unit 420 includes a closing guide means 421 provided in the rack body 411, a closing movable latching part 422, and a closing elastic member 424. The closing guide means 421 is provided on a surface in the body closing space 414 to guide the closing movable latching part 422. The closing guide means 421 is provided on a surface in the body closing space 414, and has a closing linear part 421*a* and a closing curved part 421*b*. The closing linear part 421*a* extends from a position in the closing direction to the opening direction of the storage part 20 and has the shape of a straight line. The closing curved part 421*b* is connected to the front portion of the closing linear part 421*a* placed in the opening direction and is bent downwards. The closing guide means 421 guides the drive part 117 latched by the closing movable latching part 422 to the closing linear part 421*a* when the storage part 20 moves in the opening direction from the closing state. Meanwhile, when the drive part 117 passes the closing linear part 421*a* and then is positioned in the closing curved part 421*b*, a portion of the closing guide means 421 located in the opening direction tilts downwards along the closing movable latching part 422, so that the drive part 117 is released from the closing movable latching part 422.

Further, the closing guide means 421 moves the drive part 117 in the closing direction to be latched by the closing movable latching part 422 when the storage part 20 opens and thereafter is closed again, thus guiding the drive part from the closing curved part 421*b* to the closing linear part 421*a*.

Further, a closing elastic deformation hole 421*c* is formed in a surface of the rack body 411 in such a way as to be placed on the rear portion of the closing linear part 421*a* of the closing guide means 421. In order to restore the original state after malfunction, the closing elastic deformation hole 421*c* is formed to elastically deform the closing linear part 421*a* of the closing guide means 421.

The closing movable latching part 422 is provided in the rack body 411, and is installed to be guided along the closing guide means 421. The closing movable latching part 422 is positioned in the open upper portion of the body closing space 414, and is coupled to the closing guide means 421 to move along the closing linear part 421*a* and the closing curved part 421*b*. A closing latching depression 423 is formed in the upper portion of the closing movable latching part 422 to latch the drive part 117. The drive part 117 is inserted into the rear portion of the closing latching depression 423 located in the closing direction of the storage part 20. If the storage part 20 moves from the closed position to the open position, the closing movable latching part 422 latching the drive part 117 moves together in the opening direction while being guided along the closing linear part 421*a* of the closing guide means 421. When the closing movable latching part 422 reaches the closing curved part 421*b* of the closing guide means 421, the front portion of the closing movable latching part 422 placed in the opening direction of the storage part 20 moves downwards and the front portion of the closing latching depression 423 placed in the opening direction also moves downwards, so that the drive part is released from the closing latching depression 423, and the storage part 20 moves out of the operating section of the self-closing unit 420 and thus the storage part 20 opens. If the storage part 20 has been opened and then moves to the closed position, the drive part 117 is latched by the closing latching depression 423, and the closing movable latching part 422 moves in the closing direction while being guided from the closing curved part 421*b* to the closing linear part 421*a* of the closing guide means.

Herein, the closing guide means 421 has the shape of a projection, and the closing movable latching part 422 is fitted to the projection, and the closing elastic deformation hole 421*c* is formed to open the closing linear part, thus allowing the projection-shaped closing guide means 421 to move. However, this construction is only one example provided for the sake of description. That is, the closing guide means 421 may include all means for guiding the closing movable latching part 422, and the closing movable latching part 422 guided along the closing guide means 421 and the closing elastic deformation hole 421*c* in which the closing guide means 421 is elastically deformed may be changed to suit the guide means that are used. In other words, the closing guide means 421 may have the shape of a hole, in addition to the projection. In this case, the closing movable latching part 422 may be provided with a projection which is inserted into the hole, and the closing elastic deformation hole 421*c* may be formed to partially communicate with the hole.

The closing elastic member 424 couples the closing movable latching part 422 with the rack body 411, and is secured to the rear portion of the closing movable latching part 422 located in the closing portion of the storage part 20 and to the rear portion of the rack body 411. If the storage part 20 moves from a closed state to an open state, the closing elastic member 424 coupled to the closing movable latching part 422 is stretched, thus imposing an elastic force on the closing movable latching part 422. If the closing movable latching part 422 is inserted into and supported by the closing curved part 421*b*, the closing elastic member 424 will stay in the stretched state. If the storage part 20 opens and then moves to the closed state, the closing movable latching part 422 moves from the closing curved part 421*b* to the closing linear part 421*a*, and the storage part 20 is automatically closed by the elastic force of the stretched closing elastic member. Thus, the closing elastic member 424 provides an elastic force to automatically close the storage part 20.

Further, the operation of the sliding apparatus with the self-closing means according to the eighth embodiment of the present invention will be described below with reference to FIGS. 29 to 31.

Figure 29:
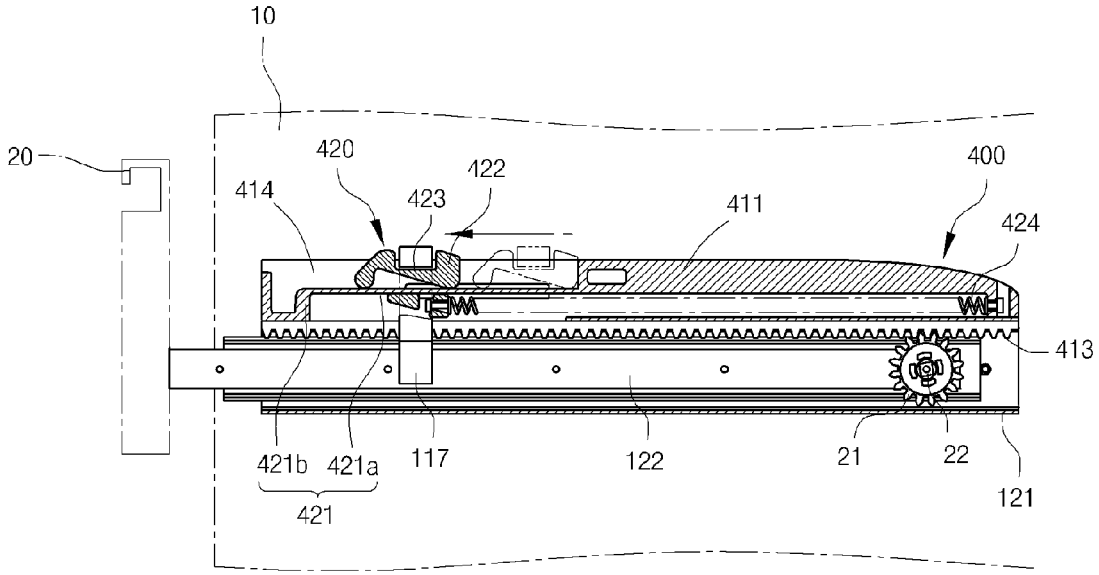
FIG. 29 is a partially cutaway side view showing the state in which the sliding apparatus with the self-closing means of FIG. 26 is mounted and the closed storage part is being opened.
Figure 30:
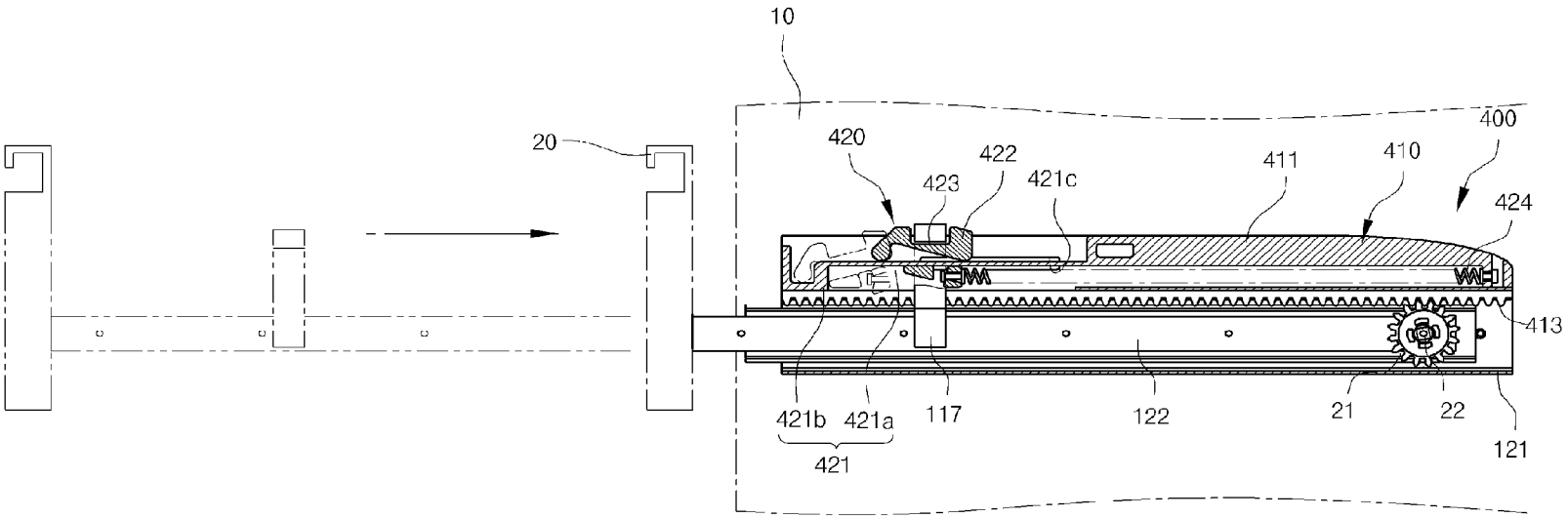
FIG. 30 is a partially cutaway side view showing the state in which the sliding apparatus with the self-closing means of FIG. 26 is mounted and the open storage part is being closed.
Figure 31:
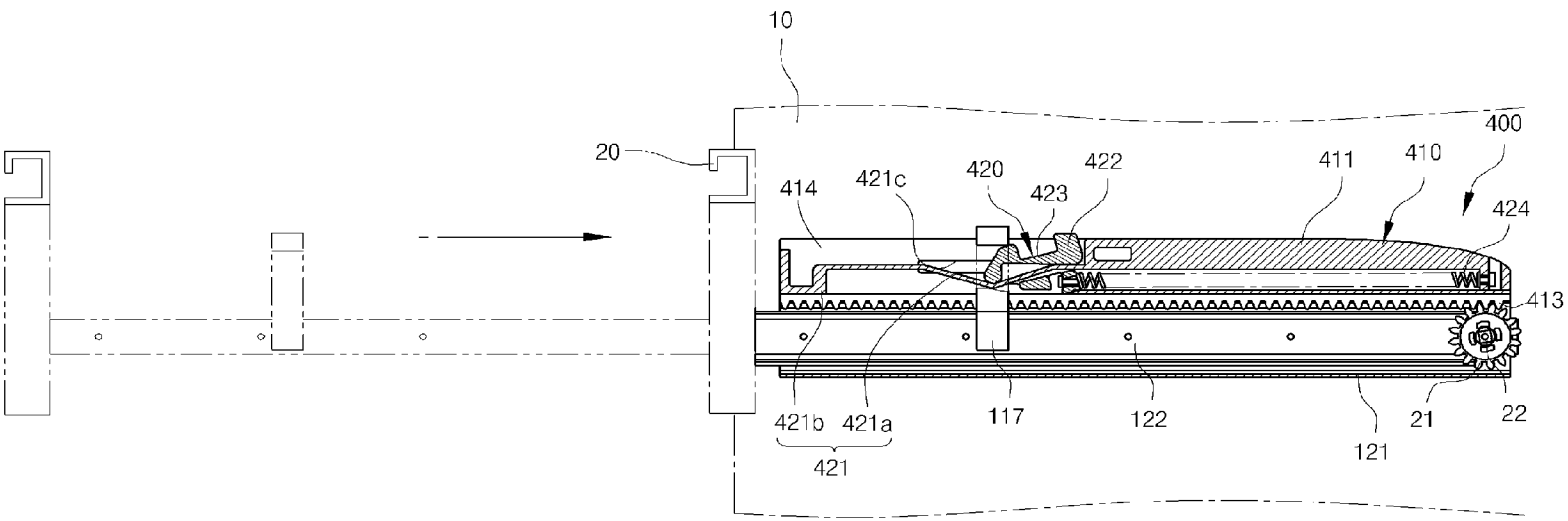
FIG. 31 is a partially cutaway side view showing the state in which the sliding apparatus with the self-closing means of FIG. 26 is mounted and is restored from a malfunction state to the original state thereof.

FIG. 29 is a partially cutaway side view showing the state in which the sliding apparatus with the self-closing means of FIG. 26 is mounted and the closed storage part is being opened, FIG. 30 is a partially cutaway side view showing the state in which the sliding apparatus with the self-closing means of FIG. 26 is mounted and the open storage part is being closed, and FIG. 31 is a partially cutaway side view showing the state in which the sliding apparatus with the self-closing means of FIG. 26 is mounted and is restored from a malfunction state to the original state thereof.

Referring to FIG. 29, when the storage part 20 is closed, the drive part 117 provided at a predetermined position of the sliding apparatus 100 is latched by the closing movable latching part 422 of the rack unit 400 which is positioned to engage with the pinion gear unit 21. In the state in which the closing movable latching part 422 is located in the closing linear part 421*a* of the closing guide means 421, the drive part 117 is inserted into the closing latching depression 423, so that the storage part 20 is latched by the self-closing unit 420. When the storage part 20 moves from the closed state to the open state, the closing movable latching part 422 latched to the drive part 117 moves in the opening direction. If the closing movable latching part 422 moves in the opening direction, the closing elastic member 424 which is elastically coupled to the closing movable latching part 422 is stretched. If the closing movable latching part 422 moves in the opening direction, the closing movable latching part 422 moves from the closing linear part 421*a* of the closing guide means 421 to be inserted into the closing curved part 421*b*, the drive part 117 is released from the closing latching depression 423, and the closing movable latching part 422 is inserted into the closing curved part 421*b*, with the closing elastic member 424 being stretched. The released storage part 20 continues to move in the opening direction, so that the storage part 20 opens.

Referring to FIG. 30, if the storage part 20 opens and then moves to the closed position, the drive part 117 is inserted into the closing latching depression 423, and the closing movable latching part 422 moves from the closing curved part 421*b* to the closing linear part 421*a* of the closing guide means 421. If the closing movable latching part 422 moves to the closing linear part 421*a*, the storage part 20 is automatically moved to the closed position by the elastic force of the stretched closing elastic member 424, so that the self-closing operation is performed.

Referring to FIG. 31, when external shock is applied in the state in which the storage part 20 is open or the closing movable latching part 422 has not been completely inserted into the closing curved part 421*b*, the storage part 20 may be moved to the closed position by the elastic force of the closing elastic member 424, so that a malfunction may occur, that is, the self-closing operation may not be performed when the storage part 20 closes. In the event of the malfunction, the storage part 20 forcibly moves to the closed position, thus moving the closing movable latching part 422 located in the closing linear part 421*a* of the closing guide means 421 downwards. Since the closing elastic deformation hole 421*c* is formed in the rear portion of the closing linear part 421*a*, the closing linear part 421*a* is elastically deformed so that the drive part 117 may be inserted into the closing latching depression 423 of the closing movable latching part 422. As the closing movable latching part 422 moves downwards, the drive part 117 is inserted into the closing latching depression 423. If the drive part 117 is inserted into the closing latching depression 423, the closing linear part 421*a* is restored from an elastically deformed state to the original state, so that the closing linear part 421*a* may be re-operated.

Moreover, a sliding apparatus with a self-closing means according to the ninth embodiment of the present invention will be described below with reference to FIG. 32.

Figure 32:
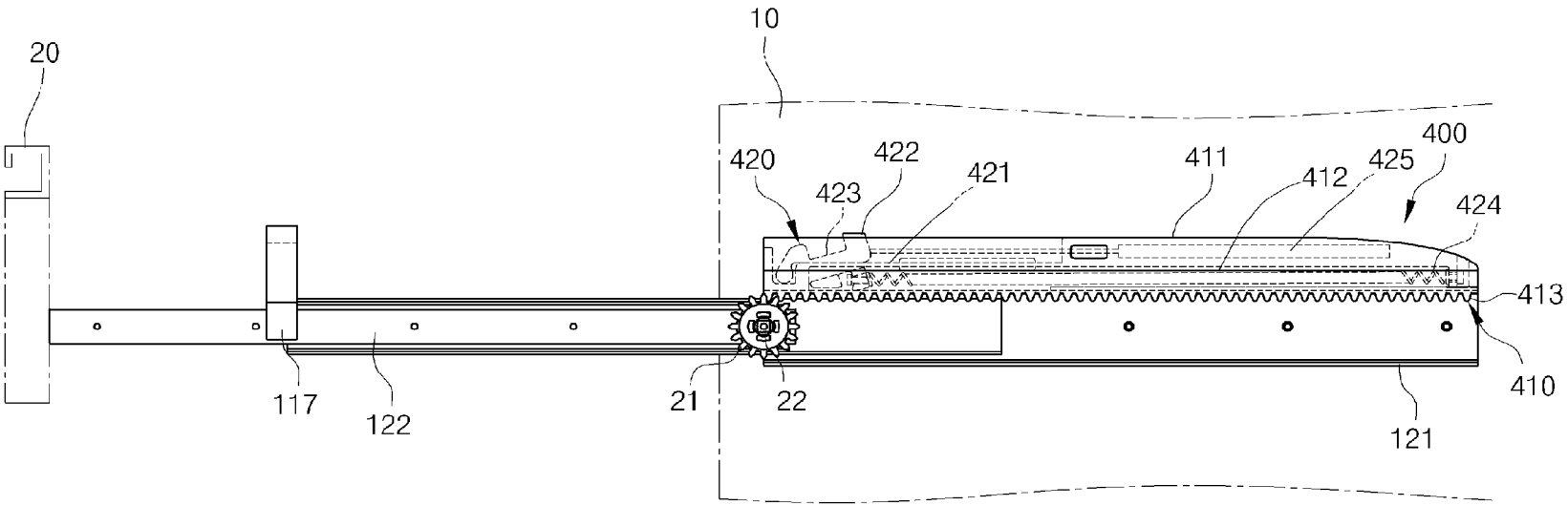
FIG. 32 is a side view showing a sliding apparatus with a self-closing means, according to a ninth embodiment of the present invention.

FIG. 32 is a side view showing a sliding apparatus with a self-closing means, according to a ninth embodiment of the present invention.

Referring to FIG. 32, the sliding apparatus 100 with the self-closing means according to the ninth embodiment of the present invention includes a rack unit 400 that is different from the rail support 110, the self-closing means 130, and the rack gear unit 140 of the sliding apparatus 100 with the self-closing means shown in FIGS. 1 to 5, and is also different from the pinion gear unit 21, the coupling bar 22, and the rack gear unit 140 of the sliding apparatus with the self-closing means shown in FIGS. 11 and 12. The remaining construction of the ninth embodiment remains the same as the above-mentioned embodiments, so the same construction will not be shown nor described. The rack unit 400 of FIG. 32 includes a rack body unit 410 and a self-closing unit 420. Since some components of the rack body unit 410 and the self-closing unit 420 are substantially identical with the components of the sliding apparatus 100 with the self-closing means shown in FIGS. 26 to 28, a detailed description will be omitted.

The self-closing unit 420 may further include a support damper 425 which is provided in a rack body 411 and is in contact with a portion of a closing movable latching part 422 located in the closing direction of the storage part 20. The support damper 425 may function to perform a smooth closing operation while absorbing some of the elastic force in the closing direction of the closing movable latching part 422 which is automatically closed by the elastic force of a closing elastic member 424. Further, when the closing movable latching part 422 moves in the opening direction of the storage part 20, the closing movable latching part 422 moves in the opening direction while being supported by the support damper 425, thus allowing the storage part 20 to be smoothly opened.

Here, the support damper 425 is a general support damper which may absorb shock using fluid such as oil, and a detailed description will be omitted.

As described above, the present invention provides a sliding apparatus with a self-closing means, in which a cover is installed toward a sliding apparatus provided on a storage part to surround the sliding apparatus slidably coupling the storage part to a main body, thus preventing corrosion and the formation of frost due to moisture produced in the main body, therefore increasing the life-span of the sliding apparatus.

Further, the present invention provides a sliding apparatus with a self-closing means, in which a cover surrounds the sliding apparatus to prevent it from being exposed to the outside, thus improving an appearance, and obviating the necessity of other operations including a coating operation for the sake of hygiene, therefore increasing productivity.

Further, the present invention provides a sliding apparatus with a self-closing means, in which the self-closing means is installed at a position which does not interfere with the sliding operation of the sliding apparatus, and a drive part for driving the self-closing means is installed at a cover surrounding the sliding apparatus, so that a self-closing operating section is provided outside the sliding range of the sliding apparatus, thus allowing a user to adjust the position and length of the self-closing section, thereby increasing the convenience of use.

Furthermore, the present invention provides a sliding apparatus with a self-closing means, in which the self-closing means has the function of restoring its original state, that is, an operable state, by the movement of a storage part, in the event of a malfunction, thus facilitating the maintenance of the self-closing means, therefore increasing operating efficiency.

Moreover, the present invention provides a sliding apparatus with a self-closing means, in which a sliding apparatus secured to a main body and the self-closing means are supported by a bracket having a cover space that permits the passage of a cover, thus improving the support strength of the sliding apparatus while minimizing interference with the movement of the cover.

Further, the present invention provides a sliding apparatus with a self-closing means, in which an elastic means for providing elastic force to the self-closing means which automatically closes a storage part slidably coupled to a main body comprises a plurality of elastic members which have different elastic forces and are coupled in series, so that the storage part is smoothly opened by the interaction between the elastic members, and the storage part is closed by the resultant force of the elastic members, thus providing a larger closing force, therefore improving the operating efficiency of the self-closing means.

Further, the present invention provides a sliding apparatus with a self-closing means, in which an elastic means comprises a plurality of elastic members which have different elastic forces and are coupled in series, and each of the elastic members is stretched when a storage part opens, so that a user can discern an open position depending on the change in elastic force of the elastic members having different elastic forces, and thus he or she can discern a position from which the self-closing operation will not be performed by the elastic force, and can discern a position from which the self-closing operation will not be performed even though an opening operation is stopped, therefore improving safety.

Furthermore, the present invention provides a sliding apparatus with a self-closing means, in which a storage part is coupled to a main body in such a way as to obliquely slide in a closing direction, and at least one stop toothed part is provided at a desired position on a fixed toothed part which is provided on the main body to engage with each of rotary toothed parts which are rotatably provided on the opposite sides of the storage part in such a way as to move at the same speed, and has a size that allows the rotary toothed part to pass the stop toothed part by external force, in addition to preventing the storage part from being moved by gravity, so that the storage part is stopped at the stop toothed part, thus allowing articles to be put in or taken out with the storage part being kept open, therefore improving the convenience of use.

Further, the present invention provides a sliding apparatus with a self-closing means, which is obliquely installed so that a storage part moves relative to a main body in a closing direction, and in which a stop toothed part is provided on a fixed toothed part engaging with a rotary toothed part which rotates when the storage part moves and has a size that prevents the movement of the storage part by gravity and allows the storage part to move when external force is applied, so that the movement of the storage part using an inclination is prevented by the stop toothed part, and the storage part moves in the closing direction when external force is applied to it again, and thus the storage part stays in a stopped state for as long as the external force is not applied, thus preventing a user's finger or an article from being caught by the storage part because of unexpected closing, therefore improving safety.

Further, the present invention provides a sliding apparatus with a self-closing means, in which a storage part does not move in response to gravity but is stopped at a position of at least one stop toothed part which is larger than teeth of a fixed toothed part, so that the storage part can maintain the stopped state at a desired position, thus allowing the moving position and the stop position of the storage part to be adjusted as desired, therefore improving the convenience of use.

Further, the present invention provides a sliding apparatus with a self-closing means, in which a storage part is installed to slide along a main body, and a rack unit engaged with the storage part and provided at a predetermined position of the main body has a self-closing function, so that the rack unit having the self-closing function is installed at a gear moving position which is spaced apart from the sliding position of the storage part, and thus the self-closing operation can be performed in the entire sliding section of the storage part, thereby improving self-closing performance.

Further, the present invention provides a sliding apparatus with a self-closing means, in which a self-closing unit is installed to provide a self-closing function to a rack unit, so that other parts are not required to implement a self-closing operation, and thus the number of parts is reduced and the number of installing processes is reduced. Consequently, the cost of installation is reduced.

Further, the present invention provides a sliding apparatus with a self-closing means, in which a self-closing unit provided on a rack unit is operated by elasticity, and is restored to its original state by the movement of a storage part even after a malfunction resulting from external shock or incomplete operation, so that a self-closing operation can be continuously implemented, and thus the convenience of use is improved.

Furthermore, the present invention provides a sliding apparatus with a self-closing means, in which a damper is installed in a rack unit to absorb some of the elastic force produced by a self-closing unit when self-closing and achieve the smooth operation thereof, thus improving operating efficiency.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A sliding apparatus with a self-closing unit, having a movable rail provided on each of opposite sides of a storage part, a fixed rail provided on each of opposite sides of a main body and coupled to the movable rail via a sliding member, respectively, in such a way as to be in rolling contact with the movable rail, and a rack unit provided on each of the opposite sides of the storage part through gear coupling in such a way as to move the storage part at the same speed, the sliding apparatus comprising:

a drive part provided on each of the opposite sides of the storage part and protruding towards the rack unit;

a rack body provided at each position of the opposite sides of the main body to engage with the storage part, and each rack body having a body closing space formed through a portion of the rack body to which the drive part is latched, the rack body placed in a position not to interfere with a sliding operation of the storage part;

a gear protrusion protruding from an inner surface of the rack body, and having on a surface thereof a rack gear to engage with the storage part; and the self-closing unit provided in the rack body, disposed in the closing space, and latching the drive part when the storage part moves, thus performing a self-closing operation, wherein the drive part moves along with the storage part when the storage part is pulled out or pushed in, and drives the self-closing unit to perform the self-closing operation, and the self-closing unit is provided in the rack body placed in an operating distance of the storage part to adjust a self-closing distance within the operating distance of the storage part.

2. The sliding apparatus as set forth in claim 1, wherein the self-closing unit comprises:

closing guide means provided in the rack body in such a way as to be located at a position in the body closing space, having a closing linear part which is provided on a central portion of the closing guide means to extend from a closed position to an opened position of the storage part, and has a shape of a straight line, and a closing curved part which is provided on an end of the closing linear part placed in an opening direction, is bent downwards, and has a shape of a curve;

a closing movable latching part provided in the rack body, located in the body closing space to be guided along the closing guide means, and having a closing latching depression at a position where the drive part moves, thus latching the drive part; and a closing elastic member elastically coupling the rack body with the closing movable latching part, wherein the closing movable latching part is guided along the closing guide means while being elastically coupled to the closing elastic member, thus automatically closing the storage part by an elastic force, and the closing movable latching part is guided to the closing curved part when the closing movable latching part moves in the opening direction of the storage part, so that a portion of the closing latching depression placed in the opening direction of the storage part moves downwards and thus the drive part is released, and the closing movable latching part is latched to the closing latching depression located at the closing curved part when the storage part is opened and then moved in a closing direction, thus performing a self-closing operation by the elastic force of the closing elastic member.

3. The sliding apparatus as set forth in claim 2, wherein a closing elastic deformation hole is formed at a position of the rack body to communicate with the body closing space, thus allowing the closing guide means to be elastically deformed in a closed position.

4. The sliding apparatus as set forth in claim 2, further comprising: a support damper provided in the rack body in such a way as to be in contact with a portion of the closing movable latching part located in the closing direction of the storage part, the support damper absorbing some of the elastic force when the closing movable latching part is moved by the elastic force of the closing elastic member, thus achieving a smooth operation.

5. The sliding apparatus as set forth in claim 1, further comprising:

a pinion gear unit comprised of a first pinion gear unit on one of the opposite sides of the storage part and a second pinion gear unit provided on the other of the opposite sides of the storage part, each of the first and second pinion gear units having a cylindrical shape, with teeth formed on an outer circumference of each of the first and second pinion gear units;

a coupling bar rotatably provided on a side of the storage part in such a way as to protrude to opposite sides, and coupling the first pinion gear unit to the second pinion gear unit;

the rack gear provided on the surface of the rack body, and protruding in a shape of gear teeth to engage with the teeth of the first and second pinion gear units; and at least one stop toothed part provided between teeth of the rack gear, and having a size which is larger than the teeth of the rack gear and allows the teeth of the first and second pinion gear units to rotate and pass the stop toothed part when a force is imparted by a user;

wherein the first and second pinion gear units are rotatably moved when the storage part moves, by engagement of the teeth of the first and second pinion gear units and the rack gear, so that both sides of the storage part move at the same speed; and the stop toothed part is provided at at least one desired position between the teeth of the rack gear engaging with the teeth of the first and second pinion gear units, so that the first and second pinion gear units rotated by movement of the storage part is stopped by the stop toothed part to be maintained in a stopped state and is rotatably moved by a user's force.

6. The sliding apparatus as set forth in claim 1, wherein the rack body is positioned above a path of the movable rail.

* * * * *